United States Patent [19]

Taguchi et al.

[11] 4,178,184

[45] Dec. 11, 1979

[54] COLOR PHOTOGRAPHIC MATERIALS CONTAINING DYE-FADING INHIBITORS

[75] Inventors: Masahiko Taguchi; Katsuo Mogaki; Syun Takada, all of Odawara, Japan

[73] Assignee: Konishiroku Photo Industry Co., Ltd., Tokyo, Japan

[21] Appl. No.: 843,261

[22] Filed: Oct. 18, 1977

[30] Foreign Application Priority Data

Oct. 23, 1976 [JP] Japan ..... 51-127427

[51] Int. Cl.[2] ..... G03C 1/76; G03C 1/06; G03C 1/40

[52] U.S. Cl. ..... 430/503; 430/551

[58] Field of Search ..... 96/56, 100, 95, 74

[56] References Cited

U.S. PATENT DOCUMENTS

| | | | |
|---|---|---|---|
| 2,735,765 | 2/1956 | Loria et al. | 96/56 |
| 3,432,300 | 3/1969 | Lestina et al. | 96/74 |
| 3,700,455 | 10/1972 | Ishikawa et al. | 96/56 |
| 3,764,337 | 10/1973 | Arai et al. | 96/84 |
| 3,930,866 | 1/1976 | Oishi et al. | 96/95 |
| 4,015,990 | 4/1977 | Ishida et al. | 96/84 UV |

*Primary Examiner*—Travis Brown
*Attorney, Agent, or Firm*—Bierman & Bierman

[57] ABSTRACT

The present invention is directed to a color photographic material which is characterized as containing a compound represented by the following formula I in combination with a compound represented by the following formula II Formula (I)

wherein R represents an alkyl group, an alkenyl group, a cycloalkyl group, an aryl group or a heterocyclic ring; $R_1$, $R_2$ and $R_3$ individually represent hydrogen, halogen, an alkyl group, an alkylthio group, an alkoxy group, an aryl group, an aryloxy group, an arylthio group, an acyl group, an acylamino group, a diacylamino group, an acyloxy group, a sulfonamido group, an alkylamino group, a cycloalkyl group or an alkoxycarbonyl group; and Z represents an atomic group or groups necessary for forming a chroman or coumaran ring; provided that R and $R_1$ can cooperatively be cyclized to form a chroman or cumaran ring.

Formula (II)

wherein $A_1$, $A_2$, $A_3$ and $A_4$ are individually alkyl having 1–18 carbon atoms, the total number of carbon atoms of $A_1$, $A_2$, $A_3$ and $A_4$ being not more than 32; and X is a simple bond, oxygen, sulfur, sulfonyl or in which $A_5$ is hydrogen or alkyl having 1–10 carbon atoms and n is an integer of 1–3.

9 Claims, No Drawings

COLOR PHOTOGRAPHIC MATERIALS CONTAINING DYE-FADING INHIBITORS

This invention relates to color photographic materials and particularly is concerned with color photographic materials in which the dye image portion and unexposed area of a dye image obtained by processing a silver halide color photographic material have been prevented form disclosing and fading due to light.

It is well known that in a silver halide color photographic material a color image is obtained when the exposed silver halide particles are developed by the use of an aromatic primary amine compound so that the oxidation product of the amine compound thereby formed reacts with a coupler to form a dye image.

Usually, in the process mentioned above the cyan, magenta and yellow dye images are formed by the use of a phenol or naphthol type coupler, a 5-pyrazolone, pyrazolinobenzimidazole, pyrazolotriazole, indazolone or cyanocetyl type coupler and an acylacetamide or dibenzylmethane type coupler, respectively.

It is desired that the dye images obtained in the above manner are not discolored nor subject to fading even when they are exposed to light and stored at an elevated temperature and humidity for a long period of time. It is well known on the other hand, however, that fastness mainly to an ultraviolet or visible ray of such dye images are not found satisfactory yet and they are readily subject to discloring and fading on irradiation of these actinic rays. In order to eliminate such drawbacks as mentioned above, there have heretofore been proposed processes to attain the purpose, in which process various couplers selected as being less in fading property are used, ultraviolet absorbers are used for the purpose of protecting the formed dye images from an ultraviolet ray, or fading inhibitors are used for preventing the formed dye images from fading due to light.

For example, various processes have heretofore been proposed to incorporate ultraviolet absorbers into color photographic materials to improve the resulting dye images in fastness to light. However, in order to impart a satisfactory light fastness to the resulting dye image using a ultraviolet absorber, a relatively large amount of the ultraviolet absorber is required, and in this case because of coloring of the ultraviolet absorber, per se, the resulting dye image was frequently stained to a considerable extent. Moreover, no effect on the prevention of fading of the resulting dye image even when the ultraviolet absorber was used, and thus there was a limit in improvement of light fastness by means of the ultraviolet absorber. Further, the use of fading inhibitors having phenolic groups or such groups as forming the phenolic groups on hydrolysis has been proposed, for example, bisphenols in Japanese Patent Publications Nos. 31256/1973 and 31625/1973; pyrogallol, gallic acid and the esters thereof in U.S. Pat. No. 3,069,262; α-tocopherols and the acyl derivatives thereof in U.S. Pat. No. 2,360,290 and Japanese Laid-Open-to-Public Patent Publication No. 27333/1976; 6-hydroxycoumarones in U.S. Pat. No. 3,432,300 and 3,574,627; 5-hydroxycoumaran derivatives in U.S. Pat. No. 3,573,050; and 6,6'-dihydroxy-2,2'-bisspirochromans.

The above-mentioned compounds certainly have their effect on light fastness of dye images, however, the effect is not sufficient and such is the actual state that their fading inhibition effect is reduced or diminishes from a certain point of time during storage of the resulting color photographic materials, an area in which unreacted coupler remains, i.e. the unexposed area, is subject to the so-called yellow color stain (hereinafter called "Y-stain"), and certain kinds, of compounds have no fading inhibition effect on dye images obtaine from yellow and cyan couplers which are however, relatively excellent when compared with dye images obtained from magenta couplers as to fading, or some of which promote contrawise fading of dye images and thus these compounds are not satisfactory yet.

An object of the present invention is to provide color photographic materials containing such fading inhibitors having excellent fading inhibition effect and Y-stain preventing effect, being excellent in solubility in high boiling solvents, dispersion stability and anti-diffusibility or the like solvents, exerting no detrimental influence on other photographic additives and causing no hinderance to color developability of couplers.

The present inventor has found, as the result of extensive studies and researchers on the subject, that the above-mentioned object can be accomplished by the use of color photographic materials containing at least one of the compounds represented by the following general formula (I) in combination with at least one of the compounds represented by the following general formula (II) (hereinafter both compounds are called "the present compounds").

General formula (I)

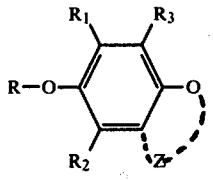

In the general formula (I), R represents an alkyl group, an alkenyl group, a cycloalkyl group, an aryl group or a heterocyclic ring; $R_1$, $R_2$ and $R_3$ individually represent hydrogen or halogen, or an alkyl group, an alkylthio group, an alkoxy group, an aryl group, an aryloxy group, an arylthio group, an acyl group, an acylamino group, a diacylamino group, an acyloxy group, a sulfonamide group, an alkylamino group, a cycloalkyl group or an alkoxycarbonyl group; and Z represents an atomic group or groups necessary for forming a chromane or coumaran ring; and further R and $R_1$ may cooperatively be cyclized to form a chromane or coumaran ring; and said chromane or coumaran rings include a chromane or coumaran nucleus substituted with halogen, an alkyl group, an alkoxy group, an alkenyl group, an alkenyloxy group, an aryl group, an aryloxy group, an amino group or a heterocylic ring or an atomic group or groups for forming a condensed-ring containing said chromane or coumaran nucleus.

Each of the above groups or rings includes the substituted, so that, for example, the alkyl group includes substituted or unsubstituted alkyl, the aryl group includes substituted or unsubstituted aryl, and the alkenyl group includes substituted or unsubstituted alkenyl. The same is true as to the rest of the groups or rings.

General formula (II)

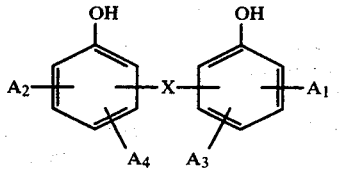

wherein $A_1$, $A_2$, $A_3$ and $A_4$ are individually alkyl having 1 to 18 carbon atoms, the total number of carbon atoms of $A_1$, $A_2$, $A_3$ and $A_4$ being not more than 32, and X is a simple bond, oxygen, sulfur, sulfonyl or

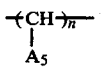

in which $A_5$ is hydrogen or alkyl having 1 to 10 carbon atoms and n is an integer of 1 to 3.

Among the compounds represented by general formula (I), those which are especially of usefulness in the present invention are compounds represented by the following general formulas (Ia), (Ib) and (Ic) respectively as mentioned below:

General formula (Ia)

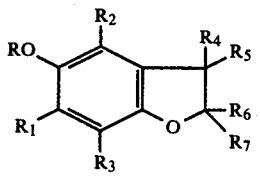

General formula (Ib)

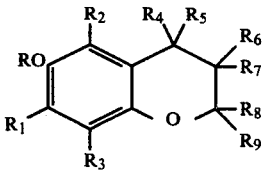

General formula (Ic)

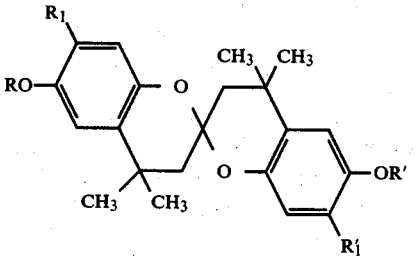

In general formulas (Ia), (Ib) and (Ic), $R_1$, $R_2$ and $R_3$ are individually as defined in general formula (I); R' is as defined for R in general formula (I); $R'_1$ is as defined for $R_1$ in general formula (I) (R and R' may be the same or different and $R_1$ and $R'_1$ may be the same or different); and $R_4$, $R_5$, $R_6$, $R_7$, $R_8$ and $R_9$ individually represent hydrogen, an alkyl group, an alkoxy group, an alkylthio group, an alkenyl group, an alkenyloxy group, an aryl group, an aryloxy group, an N-substituted amino group or a heterocylic ring; and $R_8$ and $R_9$ may cooperatively be cyclized to form a hydrocarbon ring which includes a hydrocarbon ring nucleus unsubstituted or substituted with an alkyl group, the hydrocarbon ring being such as a cyclohexane ring. As same as explained in general formula (I), all the groups and rings in general formulas (Ia), (Ib) and (Ic) include the unsubstituted or the substituted.

Particularly useful among the compounds represented by general formulas (Ia), (Ib) and (Ic) in the present invention, are those in which R and R' are individually an alkyl group or a cycloalkyl group, $R_1$, $R'_1$, $R_2$ and $R_3$ are individually hydrogen, alkyl or cycloalkyl more preferably $R_3$ is hydrogen, at least one of the $R_2$ and $R_1$ or $R'_1$ is lower alkyl especially methyl, $R_4$, $R_5$, $R_6$, $R_7$, $R_8$ and $R_9$ are individually hydrogen or halogen, alkyl or cycloalkyl, and R and $R_1$ are cooperatively cyclized to form the chromane ring and $R_8$ and $R_9$ are cooperatively cyclized to form the hydrocarbon ring. In general formula (Ib), preferably R is an alkyl group having 8–32 carbon atoms, the group including substituted or unsubstituted alkyl. More preferablly the present compounds are those represented by general formulas (Ic) and (Ib) in which general formula (Ib) R is the alkyl group of 8–32 carbon atoms.

Of the compounds represented by the general formula (I), those which are of usefulness in the present invention include also compounds represented by the following general formula (Id).

General formula (Id)

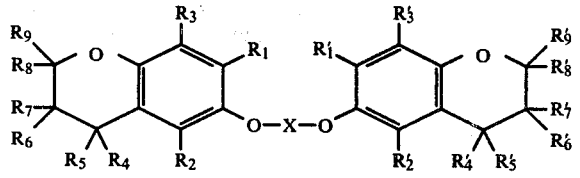

In the general formula (Id), $R_1$, $R_2$ and $R_3$ are individually as defined in the aforementioned general formula (I); and $R'_1$, $R'_2$ and $R'_3$ are respectively as defined for $R_1$, $R_2$ and $R_3$.

$R_4$, $R_5$, $R_6$, $R_7$, $R_8$ and $R_9$ are individually as defined in the aforementioned general formula (I), $R'_4$, $R'_5$, $R'_6$, $R'_7$, $R'_8$ and $R'_9$ are co-operatively defined for $R_4$, $R_5$, $R_6$, $R_7$, $R_8$ and $R_9$, and X represents an alkylene group, a phenylene group, a cycloalkylene grup or a divalent heterocyclic group. A carbon chain in the alkylene group may contain —O—, —S—, —NH— and/or —$SO_2$—therein as a chain member or members. As same as explained before, the above groups include the substituted and the unsubstituted.

Particularly useful among the compounds represented by general formula (Id) in the present invention, are those in which $R_1$ and $R'_1$ are indivicually an alkyl group; $R_2$, $R'_2$, $R_3$ and $R'_3$ are individually hydrogen, $R_5$, $R'_5$, $R_6$, $R'_6$, $R_7$ and $R'_7$ are individually hydrogen and X is alkylene or alkylene in which a carbon chain in the alkylene may be separated by —$SO_2$.

In this invention, preferably the alkyl and alkeny groups except for R in general formula (Ib) have 1–32 carbon atoms and the heterocyclic rings and the divalent heterocyclic group are of the 5- or 6-membered heterocyclic ring containing nitrogen, oxygen and/or sulfur such as those derived from piperadine, morpholine, imidazoline, thiazoline, pyridine, pyrimidine, triazine, etc.

The groups and rings appeared in all the general formulas include the substituted as explained before. Although the substituents may be any substituents, preferred ones are one or more appropriately selected from the group consisting of halogen, cyano, hydroxy, amino, nitro, sulfo, carboxy, an alkyl group, an alkenyl group, an aryl group, a cycloalkyl group, an alkoxy group, an alkenyloxy group, an aryloxy group, acyl, acyloxy, oxycarbonyl, an acylamino group, a carbamoyl group, a sulfonamido group, a sulfamoyl group, a heterocyclic ring and a mono- or di-alkylamino group among which halogen, cyano, hydroxy, amino, an alkyl group, an aryl group, oxycarbonyl and the mono- or di-alkylamino are more preferred.

Typical examples of the compound represented by the aforementioned general formula (I) are exemplified below, but the compounds used in the present invention are not limited thereto.

(1)

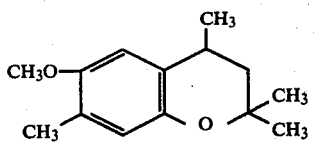

(2)

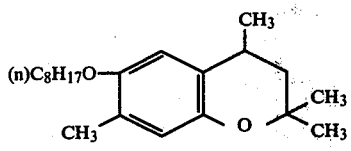

(3)

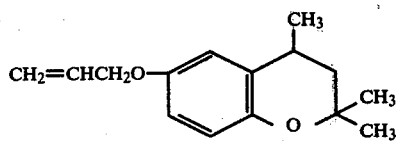

(4)

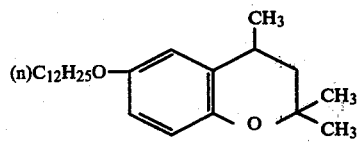

(5)

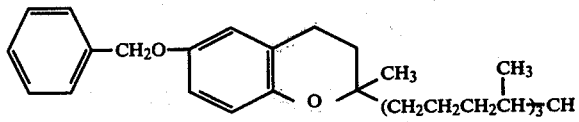

(6)

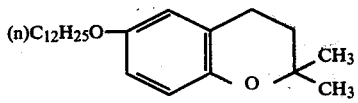

(7)

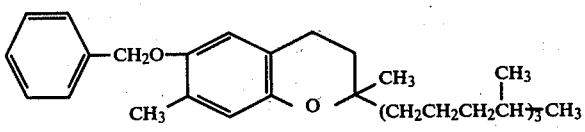

(8)

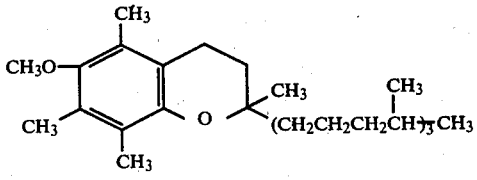

(9)

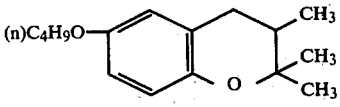

-continued
(10)
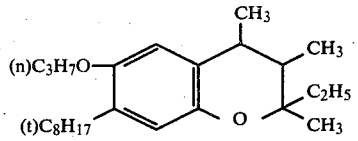
(11)
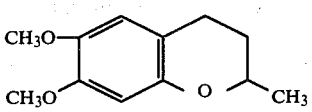
(12)
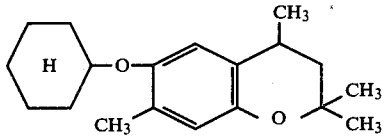
(13)
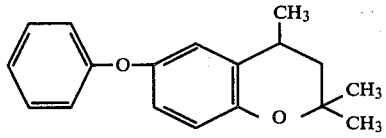
(14)
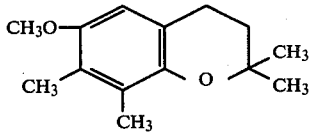
(15)
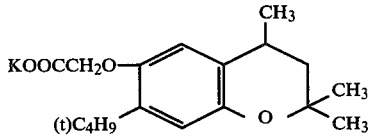
(16)
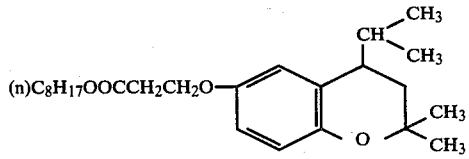
(17)
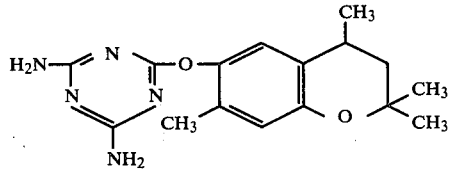
(18)
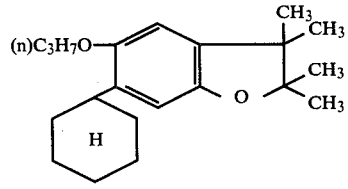
(19)
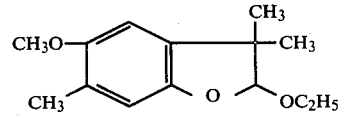

-continued
(20)
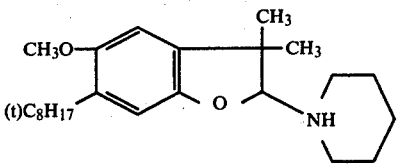
(21)
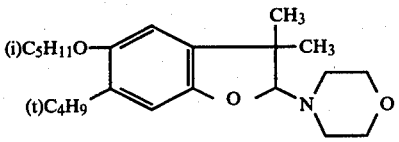
(22)
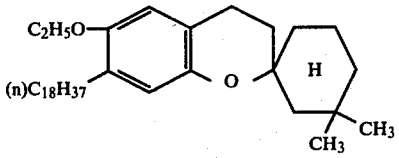
(23)
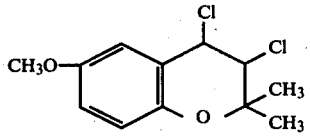
(24)
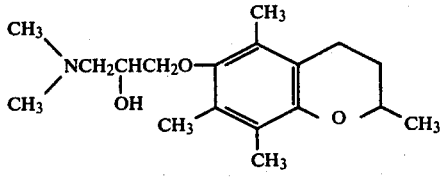
(25)
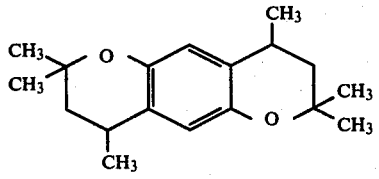
(26)
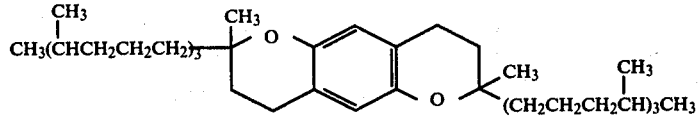
(27)
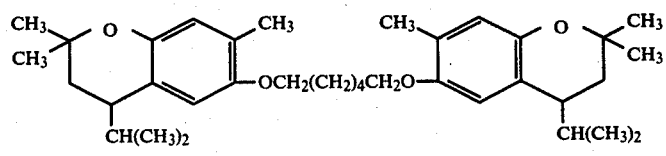
(28)
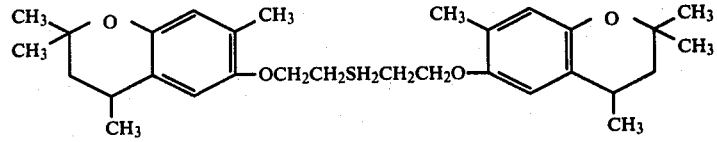

-continued
(29)
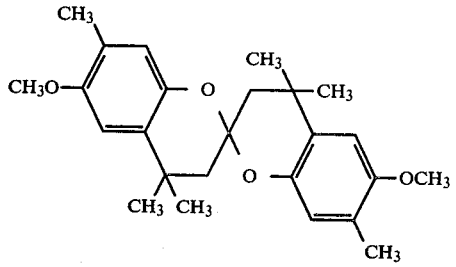
(30)
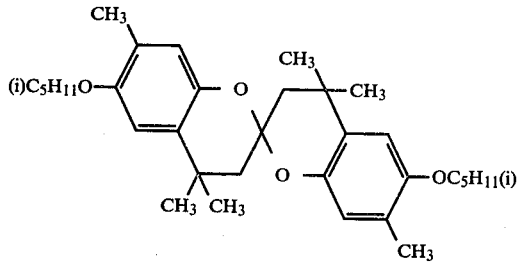
(31)
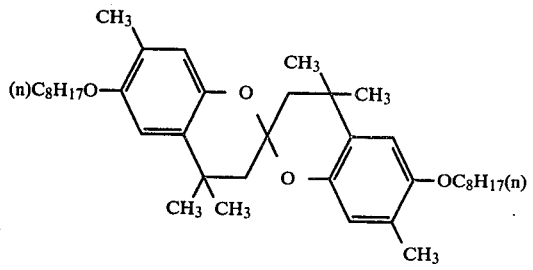
(32)
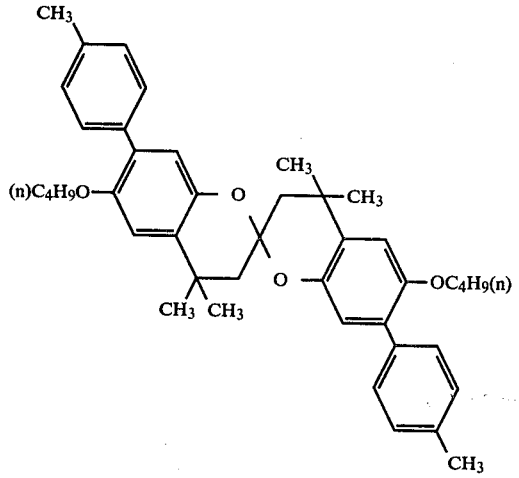
(33)
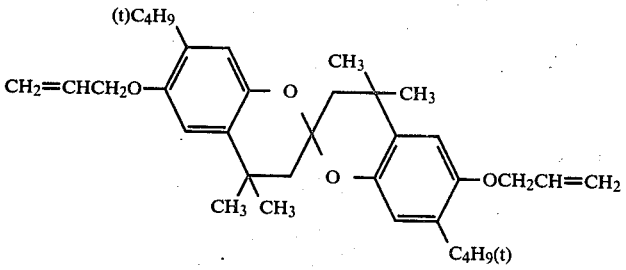

-continued
(34)
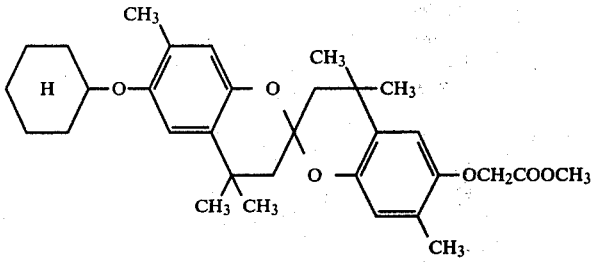
(35)
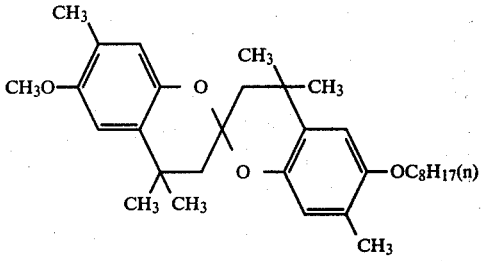
(36)
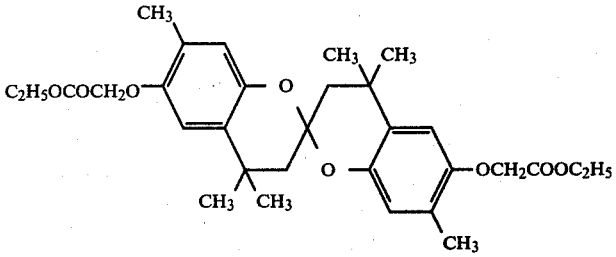
(37)
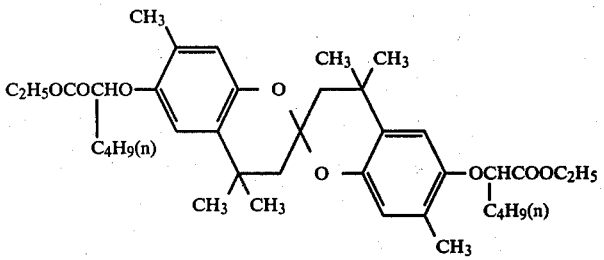
(38)
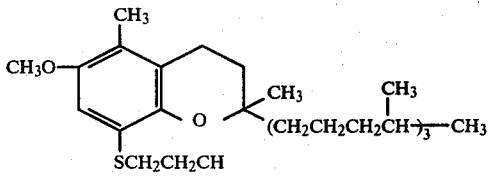
(39)
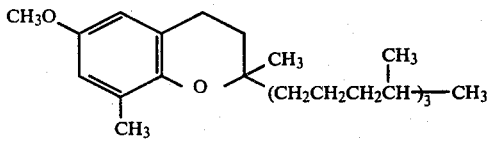
(40)
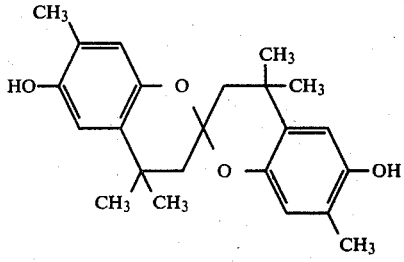

(41)

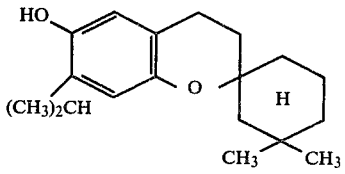

(42)

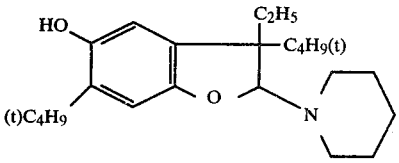

(43)

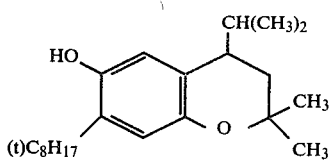

Turning to the general formula (II), the alkyl group of the compounds may be any of those straight chained and branched. There may be mentioned, for example, a methyl, ethyl, n-propyl, i-propyl, n-butyl, i-butyl, i-butyl, sec-butyl, t-butyl, n-amyl, t-amyl, t-hexyl, n-octyl, t-octyl, decyl, n-dodecyl, t-dodecyl or n-octadecyl.

Of the compounds repesented by the aforementioned general formula (II), those whoch are useful in the present invention include the compounds represented by the following general formula (IIa) or (IIb).

General formula (IIa)

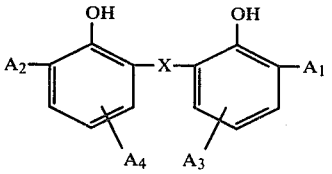

General formula (IIb)

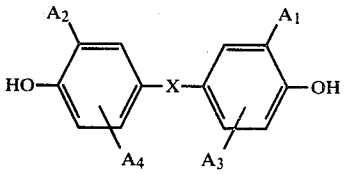

In the general formulas (IIa) and (IIb), $A_1$, $A_2$, $A_3$, $A_4$ and X individualy have the same meanings as defined in the general formula (II), and particularly useful are those in which at least one of $A_1$ and $A_2$ is a tertiary alkyl group.

Typical examples of the compound represented by the aforementioned general formula (II) are exemplified below, but the compounds used in the present invention are not limited thereto.

-continued (44)

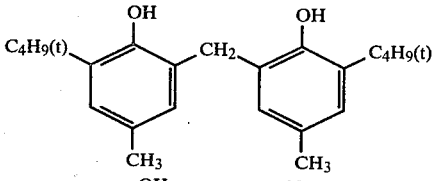

(45)

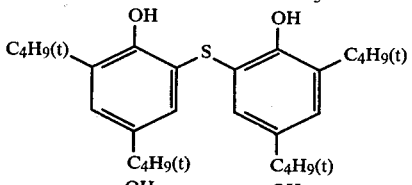

(46)

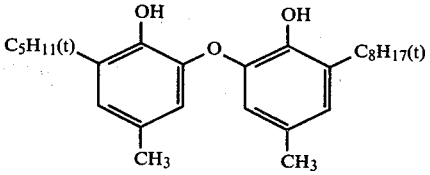

(47)

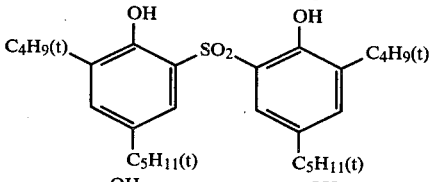

(48)

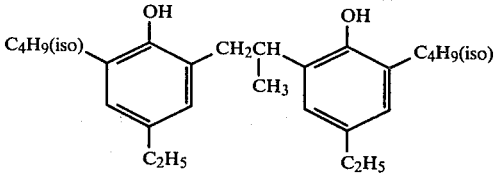

(49)

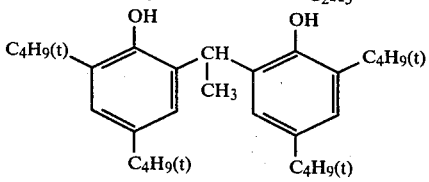

-continued
(50)
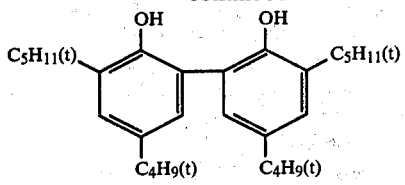
(51)
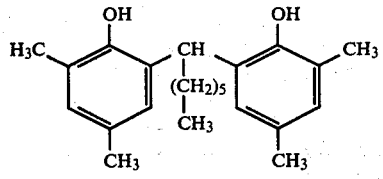
(52)
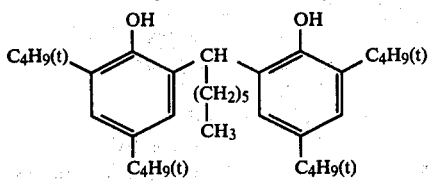
(53)
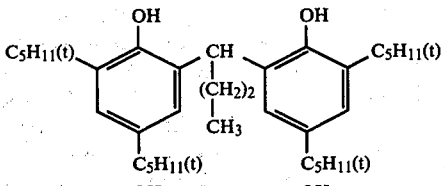
(54)
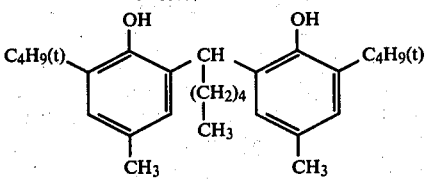
(55)
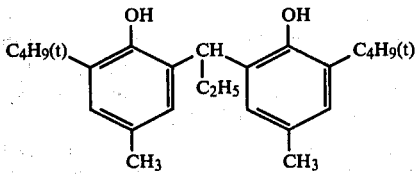
(56)
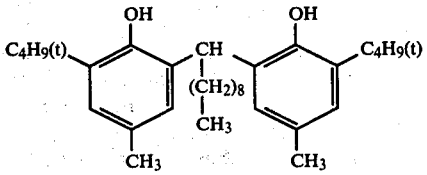
(57)
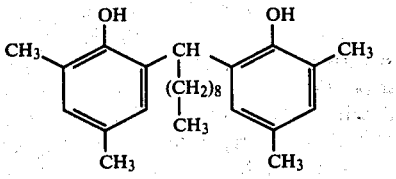
(58)
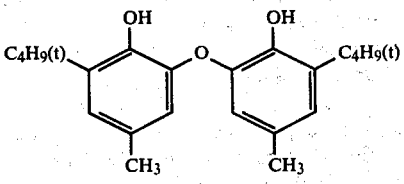
(59)
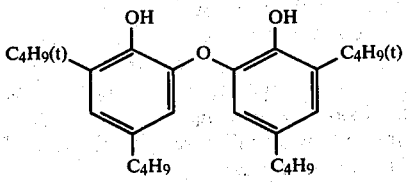
-continued
(60)
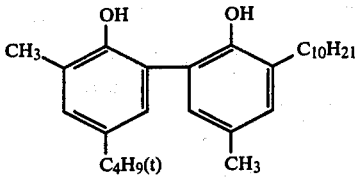
(61)
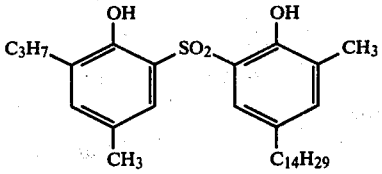
(62)
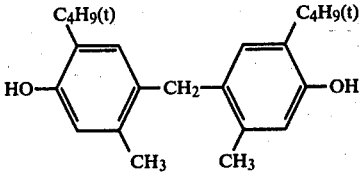
(63)
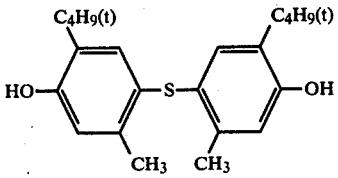
(64)
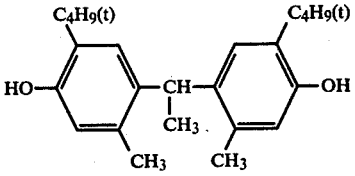
(65)
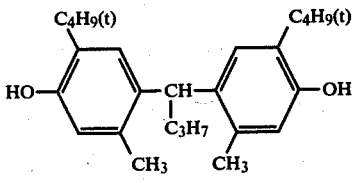
(66)
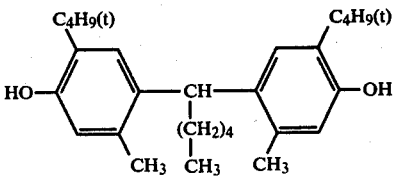
(67)
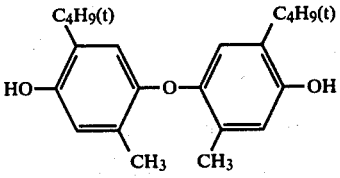
(68)
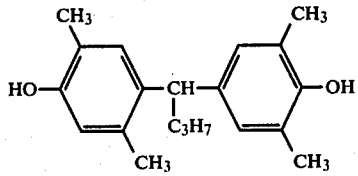
(69)
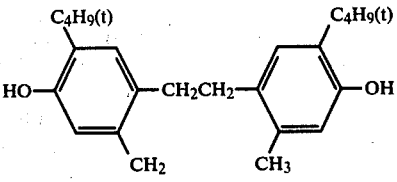

-continued (70)

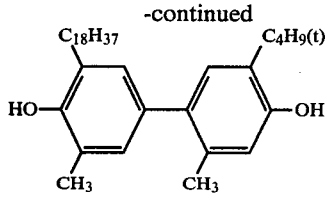

(71)

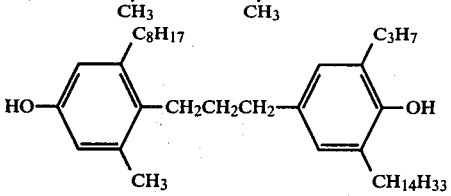

(72)

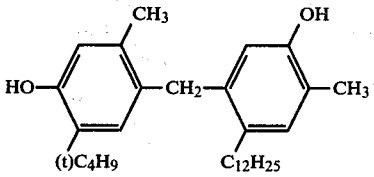

(73)

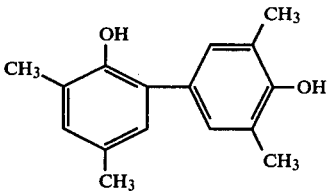

(74)

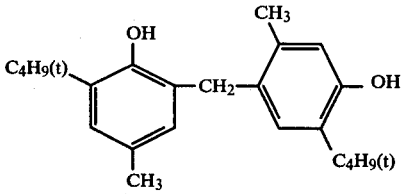

(75)

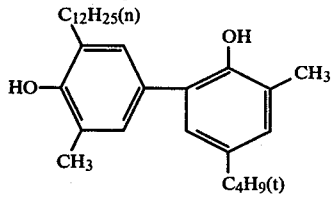

(76)

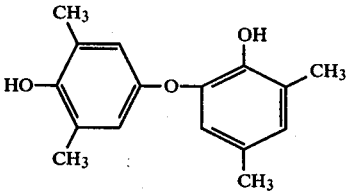

(77)

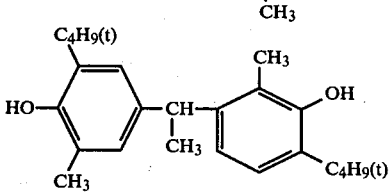

The compounds represented by the aforementioned general formula (I) may be synthesized, according to general alkylation processes, by reacting a starting compound, i.e. 6-hydroxychroman, 5-hydroxycoumaran and/or 6,6'-dihydroxy-2,2'-bisspirochromans which are obtained by the processes disclosed in the afore-mentioned U.S. Pat. Nos. 3,343,300, 3,573,050, 3,574,627 and 3,764,337, in the presence of alkali with halides, sulfuric acid esters or vinyl compounds, or by bonding phenols having ether bond at the p-position to said starting compounds according to processes disclosed in German Pat. No. 1,938,672, Journal of the American Chemical Society, Vol. 66, pp. 1523–5, Journal of the Chemical Society, p. 1850–1852 (1958), and Journal of the Chemical Society, p. 3350–3378 (1959), The compounds represented by the aforementioned general formula (II) may be synthesized according to processs disclosed in U.S. Pat. Nos. 2,792,428, 2,796,445 and 2,841,619, and Journal of the Chemical Society, p. 243 (1954).

The aforesaid excellent effects on fading inhibition, Y-stain prevention and solvent-solubility are the synergistic effects of the present compounds used in combination, which effects cannot be obtained when the present compounds are used singly. The present compounds are desirably incorporated into a silver halide emulsion layer, however, they may be incorporated into other layers, for examples, constitutive layers adjacent to the silver halide emsulsion layer.

The present compounds are oil-soluble and preferably incorporated into a silver halide emulsion after dissolving the same together with couplers in a high boiling solvent, if necessary using a low boiling solvent in combination therewith, to form a dispersion according in general to procedures disclosed in U.S. Pat. Nos. 2,322,027, 2,801,170, 2,301,171, 2,272,191 and 2,304,940. In that case, no difficulty is involved in using, if necessary, hydroquinone derivatives or known fading inhibitors in combination therewith. More concretely, the present compounds may be incorporated into a silver halide emulsion in the following manner. The present compounds and couplers, if necessary, together with hydroquinone derivatives, ultraviolet absorbers or known fading inhibitors, are simultaneously dissolved in a high boiling solvent such as organic acid amides, carbamates, esters, ketone, urea derivatives, particularly di-n-butylphthalate, tricresyl phosphate, diisooctylazelate, di-n-butylsebacate, tri-n-hexyl phosphate, N,N-diethylcaprylamidobutyl, n-pentadecylphenyl ether, triphenyl phosphate, di-octylphthalate, n-nonylphenol, N,N-diethyllaurylamide, 3-pentadecylphenylethyl ether, monophenyl-di-o-chlorophenyl phosphate or fluorinated paraffin, and/or, if necessary, in a low boiling solvent such as methyl acetate, ethyl acetate, propyl acetate, butyl acetate, butyl propionate, cyclohexanol, cyclohexanetetrahydrofuran, methyl alcohol, ethyl alcohol, acetonitrile, dimethylformamide, dioxane, methyl ethyl ketone, methyl isobutyl ketone, diethylene glycol, monoacetate, acetyl acetone, nitromethane, nitroethane, carbon tetrachloride and chloroform (these high boiling and low boiling solvents may be used either singly or in admixture thereof), and the resulting solution is mixed with an aqueous solution containing a hydrophilic binder such as gelatin and such anionic type surface active agents as alkylbenzenesulfonic acid and alkylnaphthalenesulfonic acid and/or such nonionic type surface acitive agents as sorbitansesquioleinic acid esters and sorbitanmonolauric acid esters, and the resulting mixture is subjected to a high speed rotary mixer, colloid mill or supersonic dispersion apparatus to form an emulsified dispersion which is then incorporated into the silver halide emulsion.

Of the present compounds, those, per se, which are in a liquid state at an ordinary temperature or which are relatively low in their melting points, may be used, without being dissolved in a high boiling solvent, as high boiling solvents which dissolve therein such oleophilic compounds as couplers.

In that case, if the couplers used are diffusible couplers, such couplers are incorporated into a color developer, and only the present compounds may be formed into an emulsified dispersion which is then incorporated into a silver halide emulsion.

Further, the present compounds sufficiently have their effects even when incorporated into a color photographic material which has been obtained by subjecting a silver halide color photographic material to development treatment.

Being substantially colorless, the amount of the present compounds to be incorporated is not particularly limited, because they have no detrimental influence such as coloring or stain caused by the present compounds, per se. However, the amount of the compound of the aforementioned general formula (I) is sufficiently about 15 g per 1 mole of a dye formed by color development treatment. Mainly because of an economical reason, the amount of compound of the general formula (I) used in a coupler-containing silver halide color photographic material is generally preferably 5–300% by weight, particularly preferably 10–100% by weight, based on the couplers used, and in a coupler-free silver halid color photographic material, the amount of said compound is 10–100 g per mole of silver halide, particularly preferably 15–60 g. The amount of the compound of the aforementioned general formula (II) to be incorporated into either a coupler-containing silver halide color photographic material or a coupler-free silver halide color photographic material is preferably 1–300% by weight, particularly preferably 2–100% by weight, based on the compound of the aforementioned general formula (I).

Further, in the present invention no difficulty is involved even when two or more kinds of the compounds of the general formula (I) and/or two or more kinds of the compounds of the general formula (II) are used. In that case, the amounts of both compounds used may be sufficiently the same as mentioned above.

The hydroquinone derivative may be used in combination with the compounds of the present invention effectively, including their precursors. By precursors are meant compounds which release hydroquinone derivatives on hydrolysis. As the precursors of this type, there may be mentioned, for example, compounds in which one or two hydroxyl groups of the hydroquinone necleus have been acylated (for example, one or two hydroxyl groups are converted into

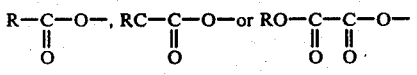

in which R represents an aliphatic group such as an alkyl group or the like group).

The hydroquinone derivatives used in the present invention include, as representatives thereof, the compounds represented by the following formula (III).

General formula (III)

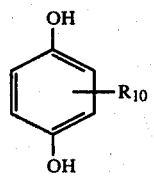

wherein $R_{10}$ represents an alkyl group (e.g. methyl, t-butyl, t-amyl, octyl, t-octyl, dodecyl and octadecyl), an aryl group (e.g. phenyl), an alkoxy group (e.g. methoxy, butoxy and dodecyloxy), an aryloxy group (e.g. phenoxy), a carbamoyl group (e.g. methylcarbamoyl, dibutylcarbamoyl, octadecylcarbamoyl and phenylcarbamoyl), a sulfamoyl group (e.g. methylsulfamoyl, and octadecylsulfamoyl, an acyl group (e.g. acetyl, octanoyl and lauroyl) an alkoxycarbonyl group (e.g. methoxycarbonyl and dodecyloxycarbonyl) or an aryloxycarbonyl group (e.g. phenyloxycarbonyl), and the alkyl and aryl in the above groups include the substituted having such substituents as halogen, alkyl, aryl, alkoxy, aryloxy, carboxy, alkoxycarbonyl, aryloxycarbonyl, acyl, acyloxy, carbamoyl, sulfo, sulfamoyl, sulfonamide, N-alkylamino, N-arylamino, acylamino, imido and hydroxy, and one to three of the remaining three hydrogen atoms on the aromatic necleus of hydroquinone may be substituted with halogen and one of the three groups (may be the same or different) of the groups defined as $R_8$.

Concrete examples of the nuclear substituted-hydroquinones usable in the present invention are disclosed, for example, in U.S. Pat. Nos. 2,336,327, 2,360,290, 2,384,658, 2,403,721, 2,418,613, 2,675,314, 2,701,197, 2,704,713, 2,710,801, 2,722,556, 2,728,659, 2,732,300, 2,735,765, 2,816,028, 3,062,884 and 3,236,893, British Pat. Nos. 557,750 and 557,802, West German Published Patent No. 2,149,789, Japanese Patent Publication No. 54116/1969, Japanese Laid-Open-to-Public Patent Publication No. 2128/1971, and Journal of Organic Chemistry, Vol. 22, pp. 772–774.

Of nuclear substituted hydroquinone derivatives, those which have the total of at least 8 carbon atoms contained in the substituents on the nucleus are low in diffusibility and suitable for being made present in specific hydrophilic layers of a light-sensitive material.

Of the hydroquinone derivatives used in the present invention, those which have substituted or unsubstituted alkyl as the nuclear-substituents are particularly useful.

Examples of the hydroquinone derivatives used in the present invention are illustrated below, but they are not limited only thereto.

Hq-1
2,5-di-ter-Octylhydroquinone
Hq-2
2-t-Octyl-5-methylhydroquinone
Hq-3
2,6-di-t-n-Dodecyl-hydroquinone
Hq-4
2-n-Dodecylhydroquinone
Hq-5
2,2'-Methlenebis-5,5'-di-t-butylhydroquinone
Hq-6
2,5-di-n-Octyl-hydroquinone
Hq-7
2-Dodecylcarbamoylmethylhydroquinone
Hq-8
2-(α-n-Dodecyloxycarbonyl)ethyl-hydroquinone
Hq-9
2-(N,N-Dibutylcarbamoyl)hydroquinone
Hq-10
2-n-Dodecyl-5-chlorohydroquinone
Hq-11
2-(2-Octadecyl)-5-methylhydroquinone
Hq-12
2,5-di-(p-Methoxyphenyl)hydroquinone Hq-13
2-t-Octylhydroquinone
Hq-14
2-[β-{3-(3-Sulfobenzamido)benzamido}ethyl]hydroquinone
Hq-15
2,5-Dichloro-3,6-diphenylhydroquinone
Hq-16
2,6-Dimethyl-3-t-Octylhydroquinone
Hq-17
2,3-Dimethyl-3-t-octylhydroquinone
Hq-18
2-{β-Dodecanoyloxy)ethyl}-carboamoylhydroquinone
Hq-19
2-Dodecyloxycarbonylhydroquinone
Hq-20
2-{β-(4-Octanamidophenyl)ethyl}hydroquinone
Hq-21
2-Methyl-5-dodecylhydroquinone These hydroquinone derivatives are used either singly or in combination of two or more and the amount thereof to be incorporated into a coupler-containing silver halide color photographic material is usually 0.01 to 10 moles, particularly preferably 0.1 to 3 moles, per mole of the coupler. In the case of a coupler-free silver halide color photographic material, the said amount is preferably 0.01 to 1.0 mole, particularly preferably 0.02 to 0.6 mole, per mole of silver halide.

Representatives of a dye image forming coupler usable in the silver halide color photographic materials of the present invention include such compounds as disclosed in the following patents.

Of the compounds, yellow dye image forming couplers are those of benzoylacetanilide type, pivaloylacetanilide type, benzoylmethane type or 2-equivalent type yellow dye image forming couplers in which the carbon atom at the coupling position has been substituted with a substituent (a so-called split off group) releasable on coupling reaction. These couplers are disclosed, for example, in U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,337,928, 3,551,155, 3,582,322 and 3,725,072, German Patent Publication Nos. 1,547,868, 2,057,841, 2,162,899, 2,163,812, 2,213,461, 2,219,917, 2,261,361 and 2,263,875, Japanese Patent Publication No. 13576/1974, Japanese Laid-Open-to-Public Patent Publications Nos. 29,432/1973, 66834/1973, 10736/1974, 122,335, 28834/1975 and 132926/1975. Magenta dye image forming couplers are those of 5-pyrazolone type, pyrazolotriazole type, pyrazolinobenzimidazole type, indazolone type, cyanoacetyl type or 2-equivalent type magenta dye image forming coupler having split off groups. These couplers are disclosed, for example, in U.S. Pat. Nos. 2,600,788, 3,062,655, 3,127,269, 3,311,476, 3,152,896, 3,419,391, 3,519,429, 3,558,318, 3,684,514, 3,888,680, 3,907,571, 3,928,044, 3,930,861, 3,930,866 and 3,933,500, Japanese Laid-Open-to-Public Patent Publications Nos. 29639/1974, 111631/1974, 129538/1974 and 13041/1975, Japanese Patent Applications Nos. 24690/1975, 134470/1975 and 156327/1975, British Pat. No. 1,247,493, Belgian Pat. No. 792,525, U.S. Pat. No. 3,061,432, West German Pat. No. 2,156,111, Japanese Patent Publication No. 60479/1971 and Belgian Pat. No. 769,116.

Cyan dye image forming couplers are those of phenol type, naphthol type or 2-equivalent type cyan dye image forming couplers having split off groups. These couplers are disclosed, for example, in U.S. Pat. Nos. 2,369,929, 2,423,730, 2,434,272, 2,474,293, 2,698,794, 2,706,684, 2,772,162, 2,801,171, 2,895,826, 2,908,573, 3,034,892, 3,046,129, 3,227,550, 3,253,294, 3,311,476, 3,386,301, 3,419,380, 3,458,315, 3,476,563, 3,516,831, 3,560,212, 3,582,322, 3,583,971, 3,591,383, 3,619,196, 3,632,347, 3,652,286, 3,737,326, 3,758,308, 3,779,763 and 3,839,044, German Patent Publication Nos. 2,163,811 and 2,207,468, Japanese Patent Publications Nos. 27563/1964 and 28836/1970, Japanese Laid-Open-to-Public Patent Publications Nos. 37425/1972, 10135/1975, 25228/1975, 112038/1975, 117422/1975 and 130,441/1975.

Typical examples of the dye image forming couplers usable in the present invention are illustrated below.

(Y-1)
α-(4-Carboxyphenoxy)-α-pivaryl-2-chloro-5-[γ-(2,4-di-t-amylphenoxy)butylamido]acetanilide
(Y-2)
α-Benzoyl-2-chloro-5-[γ-2,4-di-t-amylphenoxy)-butylamido]acetanilide
(Y-3)
α-Benzoyl-2-chloro-5[α-dodecyloxycarbonyl)-ethoxycarbonyl]acetanilide
(Y-4)
α-(4-Carboxyphenoxy)-α-pivaryl-2-chloro-5-[α-(3-pentadecylphenoxy)butylamido]acetanilide
(Y-5)
α-(1-Benzyl-2,4-dioxo-3-imidazolidinyl)-α-pivaryl-2-chloro-5-[γ-(2,4-di-t-amylphenoxy)butylamido]-acetanilide
(Y-6)
α-[4-(1-Benzyl-2-phenyl-3,5-dioxo-1,2,4-triazolidinyl)]-α-pivaryl-2-chloro-5-[γ-(2,4-di-t-amylphenoxy)butylamido]acetanilide
(Y-7)
α-Acetoxy-α-3-[α-(2,4-di-t-amylphenoxy)-butylamido]-benzoyl}-2-methoxyacetanilide
(Y-8)
α-{3-[α-(2,4-di-t-amylphenoxy)butylamido]benzoyl}-2-methoxyacetanilide
(Y-9)
α-[4-(4-Benzyloxyphenylsulfonyl)phenoxy]-α-pivaryl-2-chloro-5-[γ-(2,4-di-t-amylphenoxy)-butylamido]-acetanilide
(Y-10)
α-Pivaryl-α-(4,5-dichloro-3(2H)-pyridazo-2il)-2-chloro-5-[(hexadecyloxycarbonyl)methoxycarbonyl]-acetanilide
(Y-11)
α-Pivaryl-α-[4-(p-chlorophenyl)-5-oxo-Δ2-tetrazolin-1-il]-2-chloro-5-[α-(dodecyloxycarbonyl)ethoxycarbonyl]-acetanilide
(Y-12)
α-(2,4-dioxo-5,5-dimethyloxazolidine-3-il)-α-pivaryl-2-chloro-5-[α-(2,4-di-t-amylphenoxy)butylamido]-acetanilide
(Y-13)
α-Pivaryl-α-[4-(1-methyl-2-phenyl-3,5-dioxo-1,2,4-triazolidinyl)]-2-chloro-5-[γ-(2,4-di-t-amylphenoxy)-butylamido]acetanilide
(Y-14)
α-Pivaryl-α-[4-(p-ethylphenyl)-5-oxo-Δ2-tetrazolin-1-il]-2-chloro-5-[γ-(2,4-di-t-amylphenoxy)-butylamido)acetanilide
(M-1)

1-(2,4,6-Trichlorophenyl)-3-[3-(2,4-di-t-amylphenoxyacetamido)benzamido]-5-pyrazolone (M-2)
1-(2,4,6-Trichlorophenyl)-3-(3-dodecylsuccinimidobenzamido)-5-pyrazolone (M-3)
4,4'-Methylenebis[1-(2,4,6-trichlorophenyl)-3-[3-(2,4-di-t-amylphenoxyacetamido)benzamido]-5-pyrazolone (M-4)
1-(2,4,6-Trichlorophenyl)-3-(2-chloro-5-octadecylsuccinimidoanilino)-5-pyrazolone (M-5)
1-(2-Chloro-4,6-dimethylphenyl)-3-{3-[α-(3-pendadecylphenoxy)butylamido]benzamido}-5-pyrazolone (M-6)
1-(2,4,6-Trichlorophenyl)-3-(2-chloro-5-octadecylcarbamoylanilino)-5-pyrazolone (M-7)
3-Ethoxy-1-{4-[α-(3-pentadecylphenoxy)butylamido]-phenyl}-5-pyrazolone (M-8)
1-(2,4,6-Trichlorophenyl)-3-(2-chloro-5-tetradecanamidoanilino)-5-pyrazolone (M-9)
1-(2,4,6-Trichlorophenyl)-3-{2-chloro-5-[α-(3-t-butyl-4-hydroxyphenoxy)tetradecanamido]anilino}-5-pyrazolone (M-10)
1-(2,4,6-Trichlorophenyl)-3-[3-(2,4-di-t-amylphenoxyacetamido)benzamido]-4-acetoxy-5-pyrazolone (M-11)
1-(2,4,6-Trichlorophenyl)-3-[3-(2,4-di-t-amylphenoxyacetamido)benzamido]-4-ethoxycarbonyloxy-5-pyrazolone (M-12)
1-(2,4,6-Trichlorophenyl)-3-[3-(2,4-di-t-amylphenoxy-acetamido) benzamido]-4-(4-chlorocinnamoyloxy)-5-pyrazolone (M-13)
4,4'-Benzylidenebis[1-2,4,6-trichlorophenyl)-3-{2-chloro-5-[γ-(2,4-di-t-amylphenoxy)butylamido]-anilino}-5-pyrazolone)

(M-14)
4,4'-Benzylidenebis[1-(2,3,4,5,6-pentachlorophenyl)-3-[2-chloro-5-[γ-(2,4-di-t-amylphenoxy)-butylamido]-anilino}-5-pyrazolone)

(M-15)
4,4'-(2-Chloro)benzylidenebis[1-(2,4,6-trichlorophenyl)-3-(2-chloro-5-dodecylsuccinimidoanilino-5-pyrazolone]

(M-16)
4,4'-Methylenebis[1-(2,4,6-trichlorophenyl)-3-{3-[α-(2,4-di-t- amylphenoxy)butylamido]benzamido}-5-pyrazolone)

(M-17)
1-(2,6-Dichloro-4-methoxyphenyl)-3-(2-methyl-5-acetamidoanilino)-5-pyrazolone (M-18)
1-(2-Chloro-4,6-dimethylphenyl)-3-(2-methyl-5-chloroanilino)-5-pyrazolone (M-19)
1-(2,4,6-Trichlorophenyl)-3-(4-nitroanilino)-5-pyrazolone (C-1)
1-Hydroxy-N-[δ-(2,4-di-t-amylphenoxy)butyl]-2-naphthamide (C-2)
2,4-Dichloro-3-methyl-6-(2,4-di-t-amylphenoxyacetamido)phenol (C-3)
2,4-Dichloro-3-methyl-6-[α-(2,4-di-t-amylphenoxy)-butylamido]phenol (C-4)
1-Hydroxy-4-(3-nitrophenylsulfonamido)-N-[δ-(2,4-di-t-amylphenoxy)butyl]-2-naphthamide (C-5)
1-Hydroxy-4-[β-methoxyethyl)carbamoyl]methoxy-N-[δ-(2,4-di-t-amylphenoxy)butyl]-2-naphthamide (C-6)
1-Hydroxy-4-(isopropylcarbamoyl)methoxy-N-dodecyl-2-naphthamide (C-7)
2-Perfluorobutylamido-5-[α-(2,4-di-t-amylphenoxy)-hexanamido]phenol (C-8)
1-Hydroxy-4-(4-nitrophenylcarbamoyl)oxy-N-[δ-(2,4-di-t-amylphenoxy)butyl]-2-naphthamide (C-9)
2-(α,α, α, α-tetrafluoropropionamido)-5-[α-(2,4-di-t-amylphenoxy)butylamido]phenol (C-10)
1-Hydroxy-N-dodecyl-2-naphthamide (C-11)
1-Hydroxy-(4-nitro)phenoxy-N-[δ-(2,4-di-t-amylphenoxy)butyl]-2-naphthamide (C-12)
1-Hydroxy-4-(1-phenyl-5-tetrazolyloxy)-N-[δ-(2,4di-t-amylphenoxy)butyl]-2-naphthamide (C-13)
2-(α, α, α, α-Tetrafluoropropionamido)-4-β-chloroethoxy-5-[α-(2,4-di-t-amylphenoxy)butylamido]-phenol (C-14)
2-Chloro-3-methyl-4-ethylcarbamoylmethoxy-6-[α-(2,4-di-t-amylphenoxy)butylamido]phenol The coupler which is to be incorporated into a silver halide color photographic material according to the present invention is generally used in an amount of 5 to 50 mole%, preferably 10 to 30 mole%, based on silver halide and, on the other hand, when used in a developer the amount thereof is generally 0.5 to 3.0 g/l, preferably 1.0 to 2.0 g/l. In this case, yellow, magenta and cyan couplers may be used either singly or in combination of two or more, and the amount of couplers used in combination of two or more is sufficiently as mentioned above.

The silver halide emulsion used in the silver halide color photographic material according to the present invention is generally prepared by dispersing silver halide particles in a hydrophilic colloid. The silver halide includes silver chloride, silver bromide, silver iodide, silver chlorobromide, silver iodobromide, silver chloroiodobromide and the mixtures thereof. These silver halides are prepared according to various processes such as an ammonia process, a neutral process, the so-called conversion process and a simultaneous mixing process. The hydrophilic colloid into which the silver halide is dispersed includes, in general, gelatin and gelatin derivatives such as phthalated gelatin and maleated gelatin. The gelatin and gelatin derivatives may be replaced either partly or wholly by albumin, agar, gum arabic, and alginic acid, casein, partially hydrolyzed cellulose derivatives, partially hydrolyzed polyvinyl acetate, polyacrylamide, imidated polyacrylamide, polyvinylpyrrolidone and copolymers of these vinyl compounds. Further, these silver halide emulsions may be optically sensitized with various sensitizing dyes in order to impart sensitivity at a desired light-sensitive wavelength region to said emulsions. Preferable sensitizing dyes are cyanin dyes, merocyanin dyes or composite cyanin dyes, which are usuable either singly or in admixture of two or more, said dyes are disclosed, for example, in U.S. Pat. Nos. 1,939,201, 2,072,908, 2,688,545, 2,739,149, 2,912,329, 2,294,763, 2,213,995, 2,493,748, 2,519,001, 3,397,060 and 3,628,964, West German Pat. No. 929,080, British Pat. Nos. 1,195,302, 1,242,588, 1,293,862 and 505,979, West German patent Publications Nos. 2,030,326 and 2,121,780, Japanese Patent Publications Nos. 4,936/1968 and 14,030/1969. The silver halide emulsions may further by incorporated, if necessary, with chemical sensitizers such as gold compounds and noble metal salts such as platinum, palladium, iridium, rhodium and rthenium, sulfur compounds, reducing substances or thioether compounds, quaternary ammonium salt compounds or polyalkyleneoxide compounds, and such stabilizers as triazoles, imidazoles, azaindenes, benzothiazoliums, zinc compounds, cadmium compounds and mercaptans; chromium salts, zirconium salts and mucochloric acid; various photographic additives such film hardeners as aldehyde type, triazine type and polyepoxy compounds, active halogen compounds, ketone compounds, acryloyl type, triethylenephosphamide type and ethyleneimine type compounds; plasticizers including glycerine and such dihydroxyalkanes as 1,5-pentanediol; fluorscent brightening agents; antistatic agents and coating aids disclosed in Japanese Patent Publications Nos. 7133/1959 and 1872/1971, British Pat. Nos. 686,440, 974,723, 994,869 and 1,332,647, U.S. Pat. Nos. 682,641, 2,586,168, 2,725,294, 2,725,295, 2,732,303, 2,732,316, 2,983,611, 3,017,280, 3,091,537, 3,100,704, 3,103,437, 3,232,763, 3,288,775, 3,321,313, 3,325,287, 3,362,827, 3,543,292, 3,635,718 and 3,736,320. The silver halide thus obtained is incorporated with a dispersion of the present compounds of the general formulas [I] and [II] and then coated, if necessary, through a sub layer, an antihalation layer, an intermediate layer, a yellow filter layer, a protective layer or the like layers, on a support such as a film of such synthetic resins as cellulose acetate, cellulose nitrate, polycarbonate, polyethylene terephthalate or polystyrene, or baryta paper, polyethylene-coated paper or a glass plate, thereby to obtain a silver halide color photographic material.

The silver halide color photographic material according to the present invention may be applicable to coupler-containing inner type silver halide color photographic materials or external type silver halide color photographic materials where couplers are contained in a developer, but particularly advantageously applicable to the coupler-containing inner type silver halide color photographic materials which are advantageously developed, after exposure, according to color development method. The present invention may also be applicable to such silver halide color photographic materials that couplers and a color developing agent are made present in the same layer so as not to contact with each other by means of protection and so as to contact with each other after exposure, or also applicable to such coupler-containing silver halide color photographic materials that a color developing agent is contained in a layer which does not contain the couplers, the color developing agent is moved when an alkaline processing solution is permeated into the photographic material so as to contact with said couplers. Further, in the case of silver halide color photographic materials for diffusion transfer, the present compounds may be incorporated into a light-sensistive element and/or an image-receiving element of said photographic material, particularly advantageous is the incorporation of the present compounds into the image-receiving element. In the case of reversal method, the exposed photographic material is developed with a black-and-white developer, followed by exposure to white light or a treatment with a bath containing such fogging agent as a boron compound, and then subjected to color development with an alkaline developer containing a color developing agent. In this case, the fogging agent may be contained in the alkaline developer containing the color developing agent. The color developed photographic material is subjected to a bleaching treatment with a bleaching solution containing ferricyanide of ferric salts of aminopolycarboxylic acids and then subjected to a fixing treatment with a fixing solution containing a silver salt solvent such as thiosulfate, thereby to remove a silver image and remaining silver halide, and then a dye image is left. Bleach-fixing may be carried out by the use of a one bath bleach fixing solution containing an oxidizing agent such as ferric salts of aminopolycarboxylic acids and a silver salt solvent such as thiosulfate in place of the bleaching and fixing solutions. Further, such treatments as pre-hardening, neutralization, water-washing, stopping and stabilization can be carried out in combination with the color development, bleaching and fixing or bleach-fixing. Treatment steps by which the silver halide color photographic materials of the present invention can be advantageously color-developed include, for example, color development, if necessary, water-washing, bleach fixing, water-washing and, if necessary, stabilizing and drying. The above-mentioned treatment steps may be conducted, for example, at elevated temperatures above 30° C. and within a very short time.

Aromatic primary amine compounds as particularly useful color developing agents for the color development of the silver halide color photographic materials of the present invention are primary phenylenediamines, aminophenols and derivatives thereof and the following may be mentioned, for example, as the typical examples thereof.

The typical examples of the color developing agent include N,N-dimethyl-p-phenylenediamine, N,N-diethyl-p-phenylenediamine, N-carbamidomethyl-N-methyl-p-phenylenediamine, N-carbamidomethyl-N-tetrahydrofurfuryl-2-methyl-p-phenylenediamine, N-ethyl-N-carboxymethyl-2-methyl-p-phenylenediamine, N-carbamidomethyl-N-ethyl-2-methyl-p-phenylenediamine, N-ethyl-N-tetrahydrofurfuryl-2-methyl-p-aminophenol, 3-acetylamino-4-aminophenol, 3-acetylamino-4-aminodimethylaniline, N-ethyl-N-$\beta$-methanesulfonamidoethyl-4-aminoaniline, N-ethyl-N-$\beta$-methanesulfonamidoethyl-3-methyl-4-aminoaniline, N-methyl-N-$\beta$-sulfoethyl-p-phenylenediamine, and salts of such inorganic acids as hydrochloric acids or such organic acids as p-toluenesulfonic acid of o-aminophenol, p-aminophenol and 5-amino-2-oxy-toluene.

The color developer may be incorporated, if necessary, with various additives in addition to the above-mentioned color developing agents. Principal examples of such additives include, for example, alkali agents such as hydroxides of alkali metals or ammonium, carbonates and phosphates, buffers such as an acetic acid and a boric acid, a pH regulating agent, development accelerators, antifoggants, anti-stain or anti-sludge agents, multi-layer effect accelerators and constant state maintaining agents.

Bleaching agents used in the bleach treatment include ferricyanide, bichromates, permanganates, hydrogen peroxide, bleaching powder, metal complex salts of aminopolycarboxylic acids such as an ethylenediamine tetraacetic acid, a nitrotriacetic acid and an iminodiacetic acid, and metal complex salts and ferric chlorides of polycarboxylic acids such as a malonic acid, a tartaric acid, a maleic acid, and a digoricolic acid, and they are used singly or, if necessary, in combination thereof. The bleaching solution may also be incorporated, if necessary, with various additives such as bleaching accelerators.

Fixing agents used in the fixing treatment include thiosulfates such as sodium thiosulfate and amminium thiosulfate, cyanide and urea derivatives, and the fixing solution may be incorporated, if necessary, with various additives such as fixing accelerators.

Silver halide color photographic materials containing the present compounds may also be advantageously processed with a developer solution containing both the primary aromatic amine type color developing agent and an oxidizing agent capable of subjecting a metallic silver image to redox reaction.

When the above-mentioned color developer solution is used, the color developing agent is oxidized by the oxidizing agent and then the resulting oxidation product couples with the photographic coupler to form a dye image. Such color developer solutions are disclosed, for example, in Japanese Laid-Open-to-Public Patent Publication No. 9729/1973 and a preferable oxidizing agent for this purpose is a cobalt salt having a coordination number of 6. The color photographic treatment involving the use of such color developer solution is particularly effective for the so-called silver-saving color photographic materials, of which the amount of silver used is smaller than that in ordinary silver halide color photographic materials.

Particularly useful cobalt complex salts are those which contain a ligand selected from the group consisting of ethylenediamine, diethylenetriamine, triethylenetetramine, amine, nitrate, nitrite, azide, chloride, thiocyanate, isothiocyanate, water and carbonate and also have (1) at least 2 ethylenediamine ligands or (2) at least 5 ethylene ligands or (3) at least 1 triethylenetetramine ligand. Particularly preferably cobalt complexes are, for example, complex salts represented by the following formulas:

$(Co(En)_2(N_3)_2)X$; $[Co(En)_2Cl(NCS)]X$; $[Co(En)_2(NH_3)N_3]X$; $[Co(En)_2Cl_2]X$; $[Co(En)_2(SCN)_2]X$; $[Co(En)_2(NCS)_2]X$; and $[CO(NH_3)_6]X$.

In the above formulas, En represents ethylenediamine and X represents at least one anion selected from chloride, bromide, nitrite, nitrate, perchlorate, acetate, carbonate, sulfite, sulfate, hydrochloride, thiocyanate, isothiocyanate and hydroxide. Most preferable complex salts are hexamine salts of cobalt, for example, chlorides, bromides, sulfites, sulfates, perchlorates, nitrites and acetates. The cobalt complex salt used in the color developer solution is generally employed in the concentration range of about 0.1 to about 50 g, more preferably in the concentration range of about 1 to about 15 g, per liter of the color developer solution.

The silver halide color photographic materials using the present compounds are also advantageously subjected to a color photographic treatment comprising effecting the development of the photographic material in a color developer solution containing a primary aromatic amine type color developing agent preferably in the presence of such color developing agent as capable of being received during color development step in light-sensitive layers and being moved in an amplifying bath, and then contacting the thus processed photographic material with the amplifying bath containing the aforesaid oxidizing agent, for example, a cobalt complex salt having a coordination number 6. Other oxidizing agent preferable for use in attaining this purpose includes also an aqueous hydrogen peroxide solution disclosed, for example, in Japanese Patent Application No. 80321/1974. The amplifying bath is preferably incorporated with a silver halide development inhibitor in addition to the oxidizing, so that a silver halide color photographic material may be subjected to an amplification treatment under room illumination. According to this technique, formation of a dye can be observed and the amplification treatment can be stopped as soon as a desired dye density is attained. Preferable development inhibitors are watersoluble bromide compounds such as potassium bromide, tetrazole containing no mercapto group or ionic iodide, azaindene and heterocyclic compounds such as triazole.

The concentration of a cobalt salt to be incorporated into the amplifying bath is generally about 0.2 to about 20 g/l, most preferably about 1 to about 15 g/l. and the concentration of the aqueous hydrogen peroxide is generally about 0.01 to 10%, most preferably about 0.5 to 5%. The water-soluble bromide incorporated as the development inhibitor into the amplifying bath is generally in an amount of about 1 to about 40 g/l and, on the other hand the development inhibitor comprising a compound having a heterocyclic structure is used generally in a concentration of about 0.001 to about 5 g/l. The amplifying bath is used generally at pH 6–14, preferably pH 8–12.

The amplifying bath may be incorporated, in addition to the above-mentioned development inhibitor, with development accelerators, stabilzing agents, water-softening agents, thickeners and uneven treatment inhibitors.

The present compounds also display sufficiently their effect on the prevention of fading of diazo light-sensitive materials.

The present invention is concretely illustrated below with reference to examples, but embodiments of the invention are not limited thereby.

EXAMPLE 1

Magenta couplers, the present compounds and hydroquinone derivatives shown in Table 1–1 were individually dissolved in solvents indicated in said table to prepare solutions. The solutions were individually incorporated with 500 cc of a 5% aqueous gelatin solution containing 2.5 g of sodium dodecylbenzenesulfate and dispersed by means of a homogenizer. The dispersions thus obtained were individually incorporated into 1,000 cc of a green sensitive silver chlorobromide emulsion (containing 20 mole % of silver chloride). The emulsions individually incorporated with 10 ml of a 2% methanol solution of N,N',N''-triacryloyl-6H-S-triazine as a film hardener were individually coated on a polyethylene-coated paper and then dried dried to obtain light-sensitive siler halide photographic materials (samples Nos. 1–12). After wedgewise exposure, these samples were processed according to the under-mentioned treatment step and then irradiated for 50, 100 and 200 hours, respectively, by means of a Xenon fade-o-meter. The irradiated samples were measured with Sakura Color densitometer PD-6 Model (manufactured by Konishiroku Photo Industry Co., Ltd.) in percentage (D/Do × 100) of density (D) after irradiation relative to density (Do = 1.0) before irradiation, in the residual dye ratio with green light and in Y-stain increasing ratio with blue light. The results obtained were as shown in Table 1–2.

Treatment step (30° C.)

| Treatment step (30° C.) | |
|---|---|
| | Treatment time |
| Color development | 3 min. and 30 sec. |
| Bleach-fixing | 1 min. and 30 sec. |
| Water-washing | 2 min. |
| Stabilization | 1 min. |
| Drying | |

| Composition of color developing solution | |
|---|---|
| Benzyl alcohol | 5.0 ml |
| Sodium hexametaphosphate | 2.5 g |
| Anhydrous sodium sulfite | 1.9 g |
| Sodium bromide | 1.4 g |
| Potassium bromide | 0.5 g |
| Boric acid ($Na_2B_4O_7.10\ H_2O$) | 39.1 g |
| N-Ethyl-N-β-methanesulfonamidoethyl-4-aminoaniline sulfate | 5.0 g |
| Water to make 1 liter | |

-continued

| Composition of color developing solution |
|---|
| Adjusted to pH 10.30 with sodium hydroxide. |

| Composition of bleach-fixing solution: | |
|---|---|
| Ammonium ferric ethylenediamine-tetraacetate | 61.0 g |
| Diammonium ethylenediamine-tetraacetate | 5.0 g |
| Ammonium thiosulfate | 124.5 g |
| Sodium metabisulfate | 13.3 g |
| Anhydrous sodium sulfite | 2.7 g |
| Water to make 1 liter | |
| Adjusted to pH 6.5 with ammonia water | |

| Composition of stabilizing solution: | |
|---|---|
| Glacial acetic acid | 20 ml |
| Water to make 800 ml | |
| Adjusted to pH 3.5–4.0 and then water to make 1 liter. | |

Table 1-1

| Sample No. | Exemplified coupler and amount added (g) | | Exemplified compound and amount added (g) | | Hydroquinone compound and amount added (g) | | High boiling solvent and amount added (cc) | | Low boiling solvent and amount added (cc) | |
|---|---|---|---|---|---|---|---|---|---|---|
| | M-1 | 36 | (2) | 11 | Hq-21 | 1.1 | TCP | 36 | MA | 100 |
| 1 | | | (44) | 5 | | | | | | |
| | | | (4) | 12 | | | | | | |
| 2 | " | " | (49) | 12 | " | " | " | " | " | " |
| | | | (6) | 12 | | | | | | |
| 3 | " | " | (50) | 24 | " | " | " | " | " | " |
| | | | (19) | 12 | | | | | | |
| 4 | " | " | (58) | 12 | " | " | " | " | " | " |
| | | | (2) | 6 | | | | | | |
| 5 | " | " | (72) | 3 | " | " | " | " | " | " |
| | M-3 | 39 | (10) | 10 | Hq-3 | 1.2 | DBP | 39 | EA | 100 |
| 6 | | | (58) | 10 | | | | | | |
| | | | (19) | 12 | | | | | | |
| 7 | " | " | (62) | 24 | " | " | " | " | " | " |
| | M-3 | 39 | (26) | 18 | Hq-3 | 1.2 | DBP | 39 | EA | 100 |
| 8 | | | (60) | 18 | | | | | | |
| | | | (28) | 18 | | | | | | |
| 9 | " | " | (69) | 18 | " | " | " | " | " | " |
| | | | (30) | 14 | | | | | | |
| 10 | " | " | (44) | 7 | " | " | " | " | " | " |
| | M-4 | 39 | (29) | 14 | Hq-1 | 1.2 | DBP | 20 | EA | 100 |
| 11 | | | (44) | 14 | | | TCP | 19 | | |
| | | | (31) | 16 | | | | | | |
| 12 | " | " | (54) | 16 | " | " | " | " | " | " |
| | | | (35) | 15 | | | | | | |
| 13 | " | " | (55) | 7 | " | " | " | " | " | " |
| | | | (4) | 6 | | | | | | |
| 14 | " | " | (39) | 8 | " | " | " | " | " | " |
| | | | (55) | 14 | | | | | | |
| | | | (40) | 11 | | | | | | |
| 15 | " | " | (44) | 11 | " | " | " | " | " | " |
| | | | (43) | 11 | | | | | | |
| 16 | " | " | (44) | 11 | " | " | " | " | " | " |

In the above table, DBP represents dibutyl phthalate, TCP represents tricresyl phosphate, EA represents ethyl acetate and MA represents methyl acetate, and the same will be applied hereinafter.

Table 1-2

| Irradiation time / Sample No. | Residual dye ratio 50 | 100 | 200 | Y-stain increasing ratio 50 | 100 | 200 |
|---|---|---|---|---|---|---|
| 1 | 94 | 86 | 65 | 220 | 620 | 1,450 |
| Comparison-1 | 92 | 85 | 65 | 275 | 775 | 1,820 |
| -2 | 85 | 69 | 49 | 220 | 630 | 1,460 |
| -3 | 73 | 51 | 32 | 430 | 926 | 2,500 |
| 2 | 94 | 88 | 68 | 195 | 572 | 1,310 |
| Comparison-1 | 94 | 87 | 68 | 260 | 713 | 1,750 |
| -2 | 87 | 65 | 47 | 200 | 570 | 1,350 |
| -3 | 73 | 51 | 32 | 430 | 926 | 2,500 |
| 3 | 94 | 88 | 69 | 178 | 530 | 1,220 |
| Comparison-1 | 93 | 86 | 67 | 254 | 758 | 1,740 |
| -2 | 88 | 71 | 49 | 180 | 525 | 1,210 |
| -3 | 73 | 51 | 32 | 430 | 926 | 2,500 |
| 4 | 96 | 89 | 75 | 212 | 616 | 1,430 |
| Comparison-1 | 95 | 88 | 73 | 265 | 770 | 1,790 |
| -2 | 85 | 78 | 51 | 220 | 620 | 1,450 |
| -3 | 73 | 51 | 32 | 430 | 926 | 2,500 |
| 5 | 90 | 85 | 68 | 245 | 688 | 1,600 |
| Comparison-1 | 90 | 83 | 64 | 273 | 765 | 1,780 |
| -2 | 85 | 71 | 55 | 250 | 690 | 1,620 |
| -3 | 70 | 54 | 36 | 450 | 930 | 2,600 |
| 6 | 96 | 86 | 73 | 250 | 552 | 1,360 |
| Comparison-1 | 96 | 85 | 69 | 295 | 650 | 1,600 |
| -2 | 85 | 76 | 65 | 260 | 555 | 1,320 |
| -3 | 70 | 54 | 36 | 450 | 930 | 2,600 |
| 7 | 97 | 86 | 77 | 214 | 450 | 1,190 |
| Comparison-1 | 95 | 83 | 71 | 301 | 600 | 1,580 |
| -2 | 83 | 76 | 54 | 220 | 450 | 1,190 |
| -3 | 70 | 54 | 36 | 450 | 930 | 2,600 |
| 8 | 93 | 86 | 77 | 242 | 522 | 1,320 |
| Comparison-1 | 92 | 85 | 75 | 285 | 615 | 1,550 |
| -2 | 88 | 79 | 54 | 250 | 525 | 1,330 |
| -3 | 70 | 54 | 36 | 450 | 930 | 2,600 |
| 9 | 95 | 86 | 78 | 255 | 570 | 1,460 |
| Comparison-1 | 94 | 83 | 71 | 296 | 665 | 1,700 |
| -2 | 87 | 76 | 65 | 255 | 571 | 1,460 |
| -3 | 70 | 54 | 36 | 450 | 930 | 2,600 |
| 10 | 91 | 81 | 70 | 257 | 558 | 1,520 |
| Comparison-1 | 91 | 81 | 69 | 286 | 620 | 1,690 |
| -2 | 81 | 75 | 54 | 260 | 560 | 1,520 |
| -3 | 70 | 54 | 36 | 450 | 930 | 2,600 |
| 11 | 92 | 81 | 74 | 284 | 545 | 1,590 |
| Comparison-1 | 92 | 79 | 69 | 326 | 626 | 1,830 |
| -2 | 92 | 79 | 57 | 290 | 545 | 1,600 |
| -3 | 90 | 73 | 42 | 520 | 1,200 | 3,200 |
| 12 | 94 | 88 | 79 | 248 | 470 | 1,390 |
| Comparison-1 | 93 | 86 | 77 | 295 | 596 | 1,650 |
| -2 | 92 | 80 | 65 | 250 | 470 | 1,380 |
| -3 | 90 | 73 | 42 | 520 | 1,200 | 3,200 |
| 13 | 96 | 85 | 78 | 250 | 552 | 1,570 |
| Comparison-1 | 96 | 85 | 76 | 278 | 613 | 1,740 |
| -2 | 93 | 80 | 59 | 250 | 552 | 1,570 |
| -3 | 90 | 73 | 42 | 520 | 1,200 | 3,200 |
| 14 | 96 | 88 | 81 | 243 | 540 | 1,440 |
| Comparison-1 | 95 | 86 | 79 | 283 | 628 | 1,670 |
| -2 | 95 | 84 | 65 | 243 | 553 | 1,460 |
| -3 | 90 | 73 | 42 | 520 | 1,200 | 3,200 |
| 15 | 91 | 84 | 77 | 362 | 786 | 2,380 |
| Comparison-1 | 91 | 83 | 75 | 425 | 925 | 2,800 |
| -2 | 91 | 80 | 70 | 365 | 790 | 2,390 |
| -3 | 90 | 73 | 42 | 520 | 1,200 | 3,200 |
| 16 | 93 | 82 | 72 | 326 | 731 | 1,855 |

Table 1-2-continued

| Irradiation time / Sample No. | Residual dye ratio 50 | 100 | 200 | Y-stain increasing ratio 50 | 100 | 200 |
|---|---|---|---|---|---|---|
| Comparison-1 | 93 | 82 | 72 | 435 | 975 | 2,650 |
| -2 | 90 | 79 | 65 | 326 | 735 | 1,855 |
| -3 | 90 | 73 | 42 | 520 | 1,200 | 3,200 |

Comparative samples shown in Table 1–2 were those prepared in the following manner:

Comparative sample - 1:

This comparative sample was the same as each sample prepared under the conditions shown in Table 1–1, except that the compound of general formula (II) was omitted therefrom.

Comparative sample - 2:

This comparative sample was the same as each sample prepared under the conditions shown in Table 1–1, except that the compound of general formula (OI) was omitted therefrom.

Comparative sample - 3:

This comparative sample was the same as each sample prepared under the conditions shown in Table I–1, except that the compounds of both general formulas (I) and (II) were omitted therefrom.

As shown in Table 1–2, it is understood that the present compounds used in combination have dye fading inhibition effect and Y-stain prevention effect, which effects cannot be obtained when the present compounds are used singly.

EXAMPLE 2

The present compounds, yellow couplers and hydroquinone derivatives shown in Table 2–1 were individually dissolved in solvents indicated in said table to prepare solutions. The solutions were individually incorporated with 500 cc of a 5% aqueous gelatin solution containing 3.0 g of sodium dodecylbenzenesulfonate and then dispersed by means of a homogenizer. The dispersions thus obtained were individually incorporated into 1,000 cc of a blue-sensitive silver chloroiodobromide emulsion (containing 1 mole% of silver iodide and 80 mole% of silver bromide). The emulsions were individually incorporated with 10 ml of a 5% methanol solution of triethylenesulfonamide as a film hardener and coated on a polyethylene-coated paper and then dried to obtain light-sensitive silver halide photographic materials (samples Nos. 1–9). These samples were subjected to the same treatment as in Example 1 and then irradiated for 100 hours by means of a Xenon fade-o-meter. The samples were then subjected to measurements in the same manner as in Example 1, except that the residual dye ratio was measured using blue light. The results obtained were as shown in Table 2-2.

Table 2–1

| Sample No. | Exemplified coupler and amount added (g) | | Exemplified compound and amount added (g) | | Hydroquinone compound and amount added (g) | | High boiling solvent and amount added (cc) | | Low boiling solvent and amount added (cc) | |
|---|---|---|---|---|---|---|---|---|---|---|
| 1 | Y-3 | 81 | (2) | 18 | Hq-1 | 1.2 | DBP | 61 | EA | 120 |
| | | | (48) | 18 | | | | | | |
| 2 | " | " | (9) | 18 | " | " | " | " | " | " |
| | | | (49) | 9 | | | | | | |
| 3 | " | " | (31) | 13 | " | " | " | " | " | " |
| | | | (52) | 10 | | | | | | |
| 4 | " | " | (32) | 13 | " | " | " | " | " | " |
| | | | (44) | 13 | | | | | | |
| 5 | Y-5 | 76 | (29) | 19 | " | " | " | " | " | " |

Table 2-1-continued

| Sample No. | Exemplified coupler and amount added (g) | Exemplified compound and amount added (g) | Hydroquinone compound and amount added (g) | High boiling solvent and amount added (cc) | Low boiling solvent and amount added (cc) |
|---|---|---|---|---|---|
| | | (44) 14 | | | |
| 6 | " " | (30) 19 | " " | " " | " " |
| | | (54) 19 | | | |
| 7 | " " | (35) 19 | " " | " " | " " |
| | | (55) 8 | | | |
| 8 | " " | (36) 19 | " " | " " | " " |
| | | (55) 16 | | | |
| 9 | " " | (4) 40 | " " | " " | " " |
| | | (44) 3 | | | |

Table 2 - 2

| No. | Residual dye ratio (%) | Y-stain increasing ratio (%) |
|---|---|---|
| 1 | 68 | 95 |
| Comparison-1 | 68 | 110 |
| -2 | 53 | 100 |
| -3 | 48 | 150 |
| 2 | 72 | 89 |
| Comparison-1 | 72 | 123 |
| -2 | 58 | 115 |
| -3 | 48 | 150 |
| 3 | 79 | 90 |
| Comparison-1 | 78 | 116 |
| -2 | 61 | 100 |
| -3 | 48 | 150 |
| 4 | 82 | 101 |
| Comparison-1 | 80 | 118 |
| -2 | 69 | 110 |
| -3 | 48 | 150 |
| 5 | 89 | 99 |
| Comparison-1 | 88 | 114 |
| -2 | 80 | 100 |
| -3 | 75 | 141 |
| 6 | 90 | 98 |
| Comparison-1 | 90 | 114 |
| -2 | 80 | 100 |
| -3 | 75 | 141 |
| 7 | 91 | 100 |
| Comparison-1 | 89 | 119 |
| -2 | 80 | 105 |
| -3 | 75 | 141 |
| 8 | 94 | 130 |
| Comparison-1 | 93 | 115 |
| -2 | 81 | 110 |
| -3 | 75 | 141 |
| 9 | 93 | 100 |
| Comparison-1 | 90 | 114 |
| -2 | — | — |
| -3 | — | — |

From the results shown in Table 2-2, it is understood that the process of the present invention is excellent in fading inhibition effect on dyes formed by means of yellow couplers as well as in Y-stain prevention effect.

As can be seen from Table 2-1, the sample No. 9 was prepared by using the present compound of general formula (I) in place of a common high boiling solvent, which compound having dispersed therein coupler and other additives. From the results obtained on the sample No. 9, it is understood that the present compounds can be used also as a high boiling solvent and have excellent facing inhibition effect as well as Y-stain prevention effect even when used as the high boiling solvent.

EXAMPLE 3

The present compounds, cyan couplers and hydroquinone derivatives shown in Table 3-1 were individually dissolved in solvents shown in said table to prepare solutions. The solutions were individually incorporated with 500 cc of a 5% aqueous gelatin solution containing 0.3 g of sodium dodecylbenzenesulfonate and then dispersed by means of a homogenizer. The dispersions thus obtained were individually incorporated into 1.000 cc of a red-sensitive silver chlorobromide emulsion (containing 20 mole% of silver chloride). The emulsions were individually incorporated with 20 ml of a 4% aqueous solution of sodium 2,4-dichloro-6-hydroxy-S-triazine as a film hardener and then coated on a polyethylene-coated paper and dried to obtain light-sensitive halide photographic materials (samples Nos. 1-4). The samples were processed in the same manner as in Example 1 and then irradiated for 200 hours by means of a Xenon fade-o-meter and sunlight, respectively. The samples were then measured according to the procedure described in Example 1 using red light as to residual dye ratio, density and Y-stain of unexposed area to obtain the results as shown in Table 3-2.

Table 3 - 1

| Sample No. | Exemplified coupler and amount added (g) | Exemplified compound and amount added (g) | Hydroquinone compound and amount added (g) | High boiling solvent and amount added (cc) | Low boiling solvent and amount added (cc) |
|---|---|---|---|---|---|
| 1 | (C-2) 43 | (7) 12 | Hq-1 0.30 | DBP 21 | EA 90 |
| | | (44) 0.24 | | | |
| 2 | " | (30) 12 | " | " | " |
| | | (54) 0.48 | | | |
| 3 | (C-3) 45 | (7) 12 | Hq-1 0.34 | " | " |
| | | (44) 0.24 | | | |
| 4 | " | (30) 12 | " | " | " |
| | | (54) 0.24 | | | |

Table 3 - 2

| No. | Xenon fade-o-meter (200 hr.) Residual dye ratio (%) | Xenon fade-o-meter (200 hr.) Y-stain increasing ratio (%) | Sunlight (200 hr.) Residual dye ratio (%) | Sunlight (200 hr.) Y-stain increasing ratio (%) |
|---|---|---|---|---|
| 1 | 89 | 272 | 88 | 292 |
| Comparison-1 | 89 | 320 | 88 | 390 |
| -2 | 86 | 285 | 85 | 310 |
| -3 | 85 | 430 | 83 | 440 |
| 2 | 90 | 260 | 89 | 296 |

Table 3 - 2-continued

| No. | Xenon fade-o-meter (200 hr.) Residual dye ratio (%) | Xenon fade-o-meter (200 hr.) Y-stain increasing ratio (%) | Sunlight (200 hr.) Residual dye ratio (%) | Sunlight (200 hr.) Y-stain increasing ratio (%) |
|---|---|---|---|---|
| Comparison-1 | 90 | 330 | 89 | 390 |
| -2 | 87 | 290 | 85 | 315 |
| -3 | 85 | 430 | 83 | 440 |
| 3 | 90 | 245 | 90 | 285 |
| Comparison-1 | 90 | 285 | 89 | 375 |
| -2 | 87 | 265 | 84 | 300 |
| -3 | 85 | 325 | 86 | 450 |
| 4 | 90 | 218 | 90 | 280 |
| Comparison-1 | 90 | 280 | 89 | 360 |
| -2 | 88 | 240 | 87 | 292 |
| -3 | 85 | 325 | 86 | 450 |

Comparative samples shown in Table 3-2 were the same as those used in Example 1.

From the results shown in Table 3-2, it is understood that the color photographic materials according to the present invention have excellent dye fading ratio and Y-stain prevention effect.

EXAMPLE 4

On the surface of a polyethylene-coated paper support were successively coated under-mentioned layers to prepare a silver halide color photographic material.

First layer

A yellow coupler containing blue-sensitive silver halide emulsion was coated on the support so that the amount of silver present in the resulting coated layer became 400 mg/m². (This emulsion was a silver chloroiodobromide emulsion which contained 1 mole% of silver iodide, 80 mole% of silver bromide and 400 g of gelatin per mole of silver halide, sensitized by the use of a sensitizing dye of the following structure:

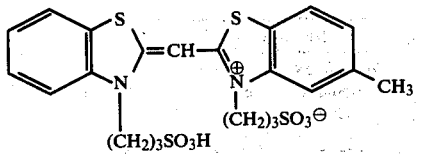

in an amount of $2.5\times10^{-4}$ mole per mole of silver halide, and contained yellow coupler (Y-6) in an amount of $2\times10^{-1}$ mole per mole of silver halide, said coupler having been dissolved and dispersed in dibutyl phthalate.

Second layer

This layer was a gelatin layer coated on the first layer so as to have a dry layer thickness of 1 μ.

Third layer

A magneta coupler containing green-sensitive silver halide emulsion was coated on the second layer so that the amount of silver present in the resulting coated layer became 300 mg/m². (This emulsion was a silver chlorobromide emulsion which contained 80 mole% of silver bromide and 500 g of gelatin per mole of silver halide, sensitized by the use of a sensitizing dye of the following structure:

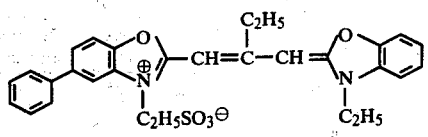

in an amount of $2.5\times10^{-4}$ mole per mole of silver halide, and contained magneta coupler (M-13) in an amount of $2\times10^{-1}$ mole of silver halide, said coupler having been dissolved and dispersed in a 2:1 mixture of dibutyl phthalate and tricresyl phosphate.

Fourth layer

This layer was a gelatin layer having a dry layer thickness of 1 μ.

Fifth layer

A cyan coupler containing red-sensitive silver halide emulsion was coated on the fourth layer so that the amount of silver present in the resulting coated layer became 500 mg/m². (This emulsion was a silver chlorobromide emulsion which contained 80 mole% of silver bromide and 500 g of gelatin per mole of silver halide, sensitized by the use of a sensitizing dye of the following structure:

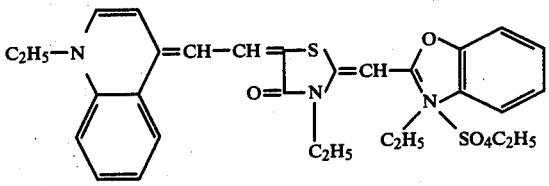

in an amount of $2.5\times10^{-4}$ mole per mole of silver halide, and contained $2\times10^{-1}$ mole of cyan coupler (C-3) per mole of silver halide, said coupler having been dissolved and dispersed in dibutyl phthalate.

Sixth layer

This layer was a gelatin layer coated so as to have a dry film thickness of 1 μ.

The silver halide emulsions used in the light-sensitive layers (the first, third and fifth layers) were prepared according to the procedure described in Japanese Patent Publication No. 7772/1971, chemically sensitized with sodium thiosulfate pentahydrate, and incorporated with 4-hydroxy-6-methyl-1,3,3*a*,7-tetrazaindene as a stabilizer, bis(vinylsulfonylmethyl)ether as a film hardener and saponin as a coating aid.

The present compounds, exemplified couplers and hydroquinone derivatives were incorporated into each emulsion layer in the manner as shown in Table 4-1 and dispersed in the same manner as in Example 1.

Table 4-1

| Sample No. | Blue-sensitive emulsion layer | Green-sensitive emulsion layer | Red-sensitive emulsion layer |
|---|---|---|---|
| 1 | 25%, based on the coupler, of exemplified compound (2) 20%, based on the exemplified compound (2), of exemplified compound (44) 2%, based on the coupler, of hydroquinone derivative Hq-1 30%, based on | 30%, based on the coupler, of exemplified compound (2) 100%, based on the exemplified compound (2), of exemplified compound (44) 3%, based on the coupler, of hydroquinone derivative Hq-1 30%, based on | 15%, based on the coupler, of exemplified compound (2) 3%, based on the exemplified compound (2), of exemplified compound (44) 0.7%, based on the coupler, of hydroquinone derivative Hq-1 15%, based on |

Table 4–1-continued

| Sample No. | Blue-sensitive emulsion layer | Green-sensitive emulsion layer | Red-sensitive emulsion layer |
|---|---|---|---|
| 2 | the coupler, of exemplified compound (30) 50%, based on the exemplified compound (30), of exemplified compound (54) 2%, based on the coupler, of hydroquinone derivative Hq-3 | the coupler, of exemplified compound (30) 50%, based on the exemplified compound (30), of exemplified compound (54) 3%, based on the coupler, of hydroquinone derivative Hq-3 | the coupler, of exemplified compound (30) 2%, based on the exemplified compound (30), of exemplified compound (54) 0.7%, based on the coupler, of hydroquinone derivative Hq-3 |

The samples prepared by the above-mentioned procedure were exposed, according to a sensitometry method, through optical wedges to blue light, green light and red light, respectively, and then processed in the same manner as in Example 1, except that the stabilization bath treatment was omitted. The processed samples were irradiated for 100 and 200 hours, respectively, by means of a Xenon fade-o-meter and then measured according to the procedure described in Example 1 in dye density and Y-stain after irradiation to obtain the results as shown in Table 4–2.

Table 4–2

| Irradiation time | Residual dye ratio (%) | | | | | | Y-stain ratio (%) | |
|---|---|---|---|---|---|---|---|---|
| | Yellow | | Magenta | | Cyan | | | |
| Sample No. | 100 | 200 | 100 | 200 | 100 | 200 | 100 | 200 |
| 1 | 95 | 79 | 95 | 82 | 97 | 85 | 325 | 470 |
| Comparison-1 | 95 | 78 | 92 | 75 | 96 | 85 | 410 | 680 |
| -2 | 91 | 72 | 83 | 65 | 94 | 82 | 390 | 580 |
| -3 | 90 | 70 | 75 | 53 | 93 | 80 | 450 | 700 |
| 2 | 93 | 77 | 97 | 83 | 98 | 87 | 360 | 516 |
| Comparison-1 | 93 | 76 | 93 | 77 | 97 | 86 | 420 | 670 |
| -2 | 91 | 72 | 80 | 62 | 95 | 83 | 395 | 573 |
| -3 | 90 | 70 | 75 | 53 | 93 | 80 | 450 | 700 |

The comparative samples shown in Table 4–2 have the same meaning as in Example 1.

From the results shown in Table 4–2, it is understood that the color photographic materials according to the present invention have an excellent facing inhibition effect and a Y-stain prevention effect.

EXAMPLE 5

A solution of 14.5 g of exemplified compound (4) and 8 g of exemplified compound (55) in a mixture of 15 cc of dibutyl phthalate and 50 g of ethyl acetate was incorporated into 120 cc of a 5% aqueous gelatin solution containing sodium dodecylbenzenesulfonate and then dispersed by means of a homogenizer. The dispersion thus obtained was incorporated into 300 cc of a green-sensitive silver chlorobromide emulsion (containing 30 mole% of silver chloride), and the resulting emulsion was coated on a polyethylene-coated paper to obtain a silver halide photographic material.

The silver halide photographic material thus obtained was exposed, according to a sensitometery method, to light through optical wedges and then processed at 24° C. according to the following order.

| Treatment step | |
|---|---|
| First development | 5 min. |
| Water-washing | 4 min. |
| Exposure | |
| Color development | 3 min. |

-continued

| Treatment step | |
|---|---|
| Water-washing | 4 min. |
| Bleaching | 4 min. |
| Fixing | 4 min. |
| Water-washing | 10 min. |

The first developer, color developer, bleaching solution and fixing solution used were those having their respective compositions as mentioned below.

| First developer composition: | |
|---|---|
| Anhydrous sodium bisulfite | 8.0 g |
| Phenidon | 0.35 g |
| Anhydrous sodium sulfite | 37.0 g |
| Hydroquinone | 5.5 g |
| Anhydrous sodium carbonate | 28.2 g |
| Sodium thiocyanate | 1.38 g |
| Anhydrous sodium bromide | 1.30 g |
| Potassium iodide (0.1% aqueous solution) | 13.0 ml |
| Water to make 1 liter (pH 9.9) | |

| Color developer composition: | |
|---|---|
| Anhydrous sodium sulfite | 10.0 g |
| N,N-Diethyl-p-phenylenediamine hydrochloride | 3.0 g |
| Magenta coupler (M-19) | 2.0 g |
| Water to make 1 liter | |
| Adjusted to pH 11.5 with sodium hydroxide. | |

| Bleaching solution composition: | |
|---|---|
| Anhydrous sodium bromide | 43.0 g |
| Potassium ferricyanide | 165.0 g |
| Borax ($Na_2B_4O_7$ 10 $H_2O$) | 1.2 g |
| Water to make 1 liter. | |

| Fixing solution composition: | |
|---|---|
| Sodium thiosulfate (pentahydrate) | 200 g |
| Anhydrous sodium sulfate | 100 g |
| Anhydrous sidodium phosphate | 15.0 g |
| Water to make 1 liter. | |

The color photographic material (test sample) was measured as to dye fading ratio and Y-stain increasing ratio of unexposed area in the same procedure as in Example 1, except that the sample was irradiated for 200 hours by means of a Xenon fade-o-meter to obtain the results as shown in Table 5 - 1.

Table 5–1

| | Residual dye ratio (%) | Y-stain increasing ratio (%) |
|---|---|---|
| Test sample | 87 | 112 |
| Comparative sample - 1 | 85 | 148 |
| - 2 | 72 | 127 |
| - 3 | 51 | 530 |

The comparative samples shown in Table 5 - 1 were the same meanings as in the comparative samples prepared and used in Example 1.

From Table 5 - 1, it is understood that the present compounds have an excellent fading inhibition effect and a Y-stain prevention effect even when used in the so-called external type silver halide color photographic material containing no coupler.

What is claimed is:

1. A color photosensitive material comprising a support and a silver halide photosensitive layer, said material containing a first compound represented by formulas (Ia), (Ib), or (c) in combination with a second compound represented by formula (II)

Formula (Ia)

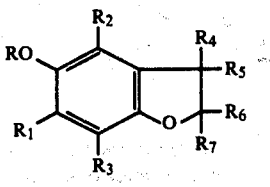

Formula (Ib)

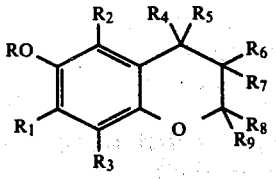

Formula (Ic)

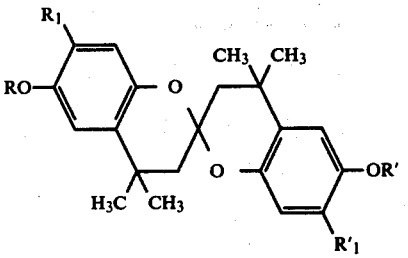

wherein R, R' and R'$_1$, individually represent an alkyl group, an alkenyl group, a cycloalkyl group, an aryl group, or a heterocyclic ring; and $R_4$, $R_5$, $R_6$, $R_7$, $R_8$ and $R_9$ individually represent hydrogen, an alkyl group, an alkoxy group, an alkylthio group, an alkenyl group, an alkenyloxy group, an aryl group, an aryloxy group, an amino group or a heterocyclic group selected from piperadine, morpholine, imidazoline, thiazoline, pyridine, pyrimidine, and triazine; provided that $R_8$ and $R_9$ can cooperatively be cyclized to form a cyclohexane ring which may be substituted with alkyl;

Formula (II)

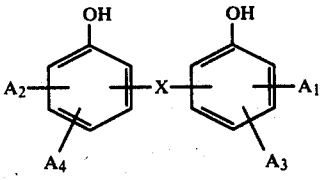

wherein $A_1$, $A_2$, $A_3$ and $A_4$ are individually alkyl having 1-18 carbon atoms, the total number of carbon atoms of $A_1$, $A_2$, $A_3$ and $A_4$ being not more than 32; and X is a simple bond, oxygen, sulfur, or

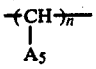

in which $A_5$ is hydrogen or alkyl having 1-10 carbon atoms and n is an integer of 1-3.

2. A color photosensitive material comprising a support, a cyan coupler containing silver halide photosensitive emulsion layer, a magenta coupler containing silver halide photosensitive emulsion layer, and a yellow coupler containing silver halide photosensitive emulsion layer, said material containing a first compound represented by formulas (Ia), (Ib), or (Ic) in combination with a second compound represented by formula (II)

Formula (Ia)

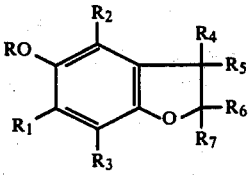

Formula (Ib)

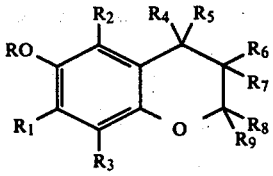

Formula (Ic)

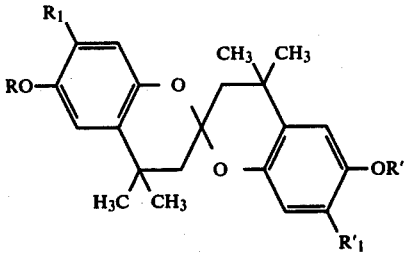

wherein R, R', and R'$_1$ individually represent an alkyl group, an alkenyl group, a cycloalkyl group, an aryl group, or a heterocyclic ring; and $R_4$, $R_5$, $R_6$, $R_7$, $R_8$ and $R_9$ individually represent hydrogen, an alkyl group, an alkoxy group, an alkylthio group, an alkenyl group, an alkenyloxy group, an aryl group, an aryloxy group, an amino group or a heterocyclic group selected from piperadine, morpholine, imidazoline, thiazoline, pyridine, pyrimidine, and triazine; provided that $R_8$ and $R_9$ can cooperatively be cyclized to form a cyclohexane ring which may be substituted with alkyl;

Formula (II)

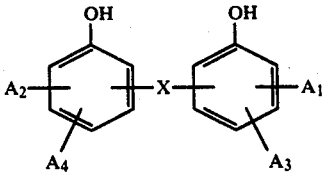

wherein $A_1$, $A_2$, $A_3$ and $A_4$ are individually alkyl having 1-18 carbon atoms, the total number of carbon atoms of $A_1$, $A_2$, $A_3$ and $A_4$ being not more than 32; and X is a simple bond, oxygen, sulfur, or

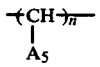

in which $A_5$ is hydrogen or alkyl having 1–10 carbon atoms and n is an integer of 1–3.

3. The color photosensitive material according to claim 1 wherein said first compound is selected from the compounds represented by formulas (Ib) and (Ic).

4. The color photosensitive material according to claim 2 wherein at least one of the three emulsion layers contains said first compound in combination with said second compound.

5. The color photosensitive material according to claim 4 wherein the magenta coupler containing silver halide photosensitive emulsion layer contains said first compound in combination with said second compound.

6. The color photosensitive material according to claim 3 wherein R in formula (Ib) is an alkyl group having 8–32 carbon atoms.

7. The color photosensitive material according to claim 6 wherein R in formula (Ib) is an alkyl group having 12–32 carbon atoms.

8. The color photosensitive material according to claim 2 wherein the compound of formula (II) is represented by the following formula:

Formula(IIa)

-continued

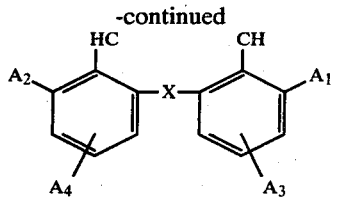

Formula (IIb)

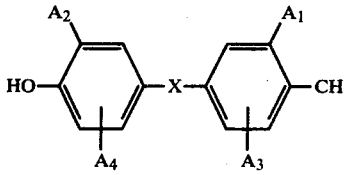

wherein $A_1$, $A_2$, $A_3$ and $A_4$ are individually alkyl having 1–18 carbon atoms, the total number of carbon atoms of $A_1$, $A_2$, $A_3$ and $A_4$ being not more than 32, and X is a simple bond, oxygen, sulfur, sulfonyl or

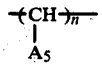

in which $A_5$ is hydrogen or alkyl having 1–10 carbon atoms and n is an integer of 1–3.

9. The color photosensitive material of claim 8 wherein at least one of $A_1$ and $A_2$ is a tertiary alkyl group.

* * * * *